US011746428B2

(12) United States Patent
Stuart et al.

(10) Patent No.: US 11,746,428 B2
(45) **Date of Patent: *Sep. 5, 2023**

(54) FILTER PRESS END ASSEMBLY AND FLUID MANAGEMENT SYSTEM FOR USE IN UNIPOLAR ELECTROCHEMICAL DEVICES

(71) Applicant: KEY DH IP INC./IP STRATEGIQUES DH, INC., Toronto (CA)

(72) Inventors: Andrew T. B. Stuart, Ravenna (CA); Raynald G. Lachance, Levis (CA); Edward D. B. Stuart, Ravenna (CA); Jaideep S. Spal, Brampton (CA)

(73) Assignee: KEY DH IP INC./IP STRATEGIQUES DH, INC., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/858,786

(22) Filed: Jul. 6, 2022

(65) Prior Publication Data

US 2022/0349071 A1 Nov. 3, 2022

Related U.S. Application Data

(63) Continuation of application No. 17/469,734, filed on Sep. 8, 2021, now Pat. No. 11,401,615.

(Continued)

(51) Int. Cl.
*C25B 9/73* (2021.01)
*C25B 9/60* (2021.01)

(Continued)

(52) U.S. Cl.
CPC ..... *C25B 9/73* (2021.01); *C25B 1/04* (2013.01); *C25B 9/60* (2021.01); *C25B 15/08* (2013.01); *C25B 1/34* (2013.01)

(58) Field of Classification Search
CPC .... C25B 1/04; C25B 9/60; C25B 9/73; C25B 15/08
See application file for complete search history.

(56) References Cited

U.S. PATENT DOCUMENTS 1,597,552 A 8/1926 Stuart
3,451,915 A 6/1969 Westerlund
(Continued)

FOREIGN PATENT DOCUMENTS

WO WO-2008015528 A1 * 2/2008 ..... H01M 8/0228

OTHER PUBLICATIONS

Dec. 3, 2021 USPTO Office Action (U.S. Appl. No. 17/469,734)—Our Matter 10241.

(Continued)

*Primary Examiner* — Ciel P Contreras
(74) *Attorney, Agent, or Firm* — Forsgren Fisher McCalmont DeMarea Tysver LLP; James M. Urzedowski; Daniel A. Tysver

(57) ABSTRACT

Disclosed is an end assembly for use in a unipolar filter press electrolyser, where the unipolar filter press electrolyser has a filter press stack. The end assembly of the unipolar filter press electrolyser includes an end plate component having two apertures, the two apertures being alignable with channels formed in the filter press stack. The two apertures include a first aperture configured to receive a stream of liquid electrolyte and gases from the filter press stack, and a second aperture configured to receive a stream of recirculated liquid electrolyte. In addition, the end assembly includes an end clamp configured to apply a clamping force on the end plate component to securely retain the filter press stack. The end clamp includes one gas offtake port to extract (Continued)

gases from the stream of liquid electrolyte and gases from the first aperture and discharge the gases out of the unipolar filter press electrolyser.

31 Claims, 33 Drawing Sheets

Related U.S. Application Data

(60) Provisional application No. 63/076,180, filed on Sep. 9, 2020.

(51) Int. Cl.

| | |
|---|---|
| ***C25B 15/08*** | (2006.01) |
| ***C25B 1/04*** | (2021.01) |
| *C25B 1/34* | (2006.01) |

(56) References Cited

U.S. PATENT DOCUMENTS

| | | | |
|---|---|---|---|
| 4,444,632 | A | 4/1984 | Denora |
| 4,482,448 | A | 11/1984 | Bowen |
| 4,490,231 | A | 12/1984 | Boulton |
| 4,605,482 | A | 8/1986 | Shiragami |
| 6,080,290 | A | 6/2000 | Stuart |
| 6,461,488 | B1 | 10/2002 | Bronold |
| 8,308,917 | B2 | 11/2012 | Hinatsu |
| 2002/0100681 | A1 | 8/2002 | Kirk |
| 2006/0231386 | A1 | 10/2006 | Kanematsu |
| 2007/0278085 | A1 | 12/2007 | Iino |
| 2018/0320275 | A1 | 11/2018 | Lin |

OTHER PUBLICATIONS

R. L. Leroy and A.K. Stuart, "Advanced Unipolar Electrolysis", journal, Jun. 6, 1981, vol. 6, No. 6, pp. 589-599, International Association for Hydrogen Energy.

R. L. Leroy, "Industrial Water Electrolysis: Present and Future", journal, Oct. 29, 1982, vol. 8, No. 6, pp. 401-417, International Association for Hydrogen Energy.

Mar. 25, 2022 USPTO Office Action (U.S. Appl. No. 17/469,734)—Our Matter 10241.

* cited by examiner

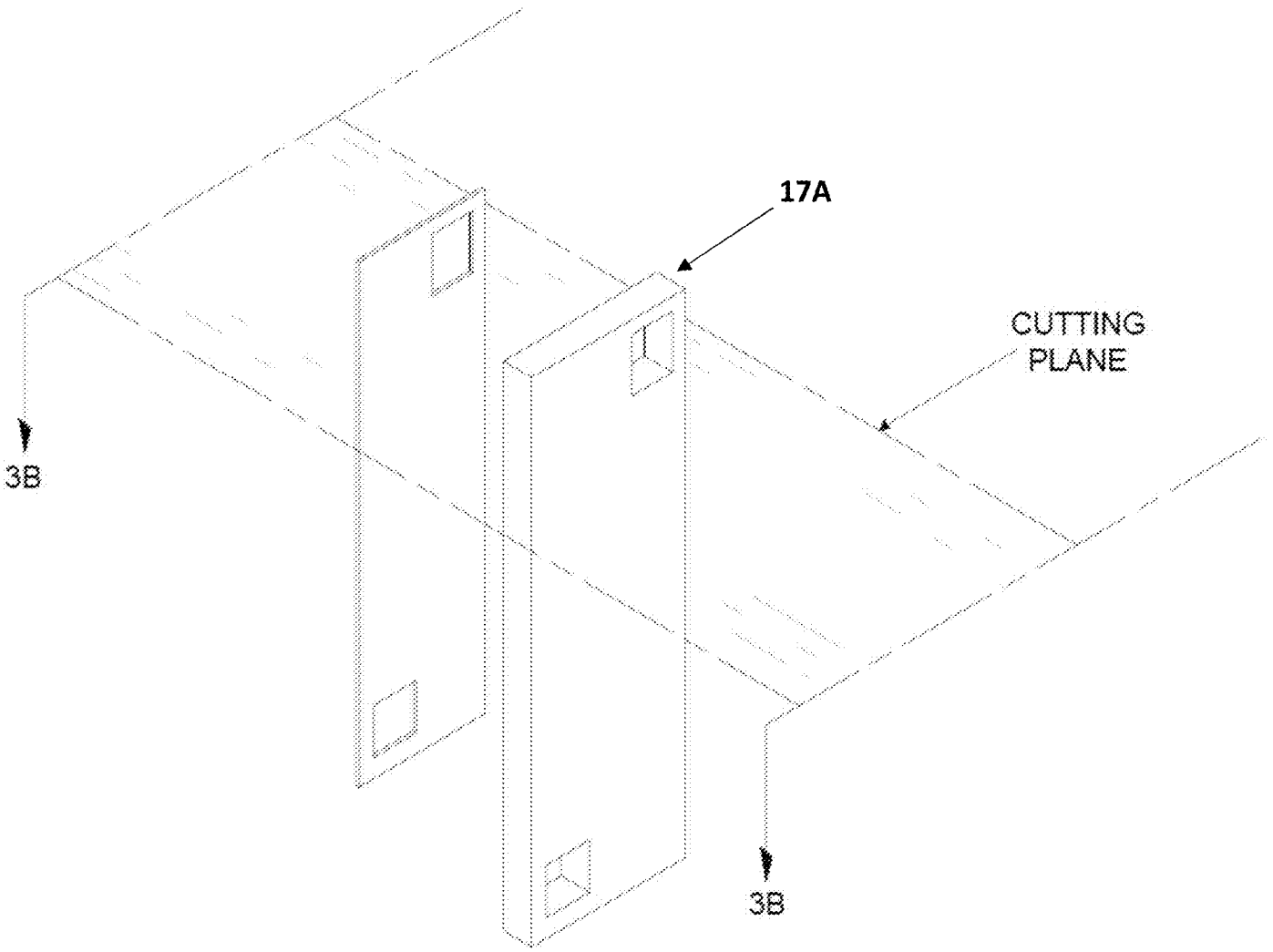
FIGURE 3A – PRIOR ART

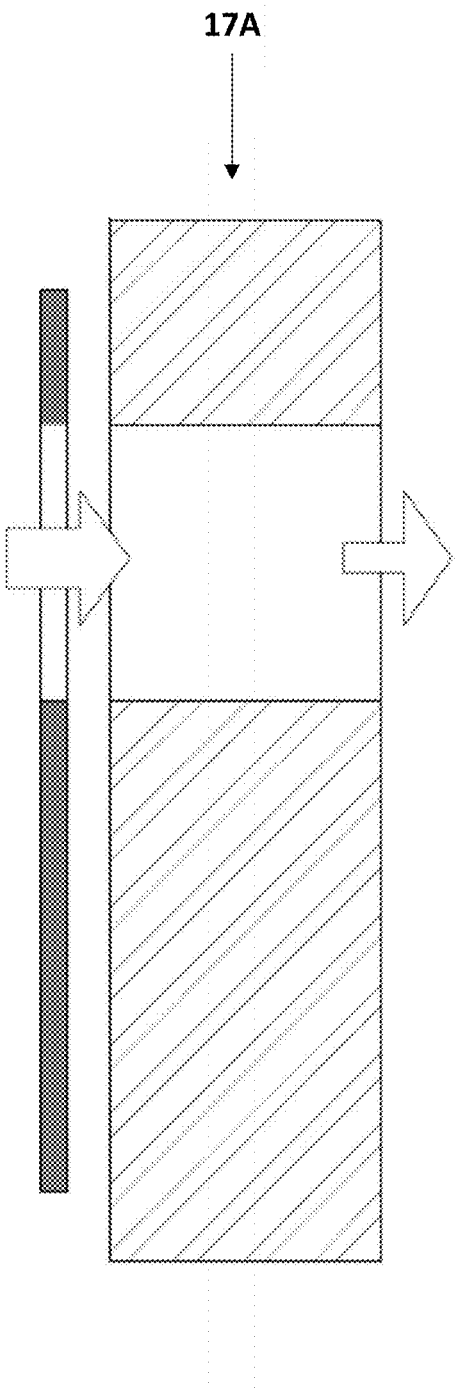
FIGURE 3B – PRIOR ART

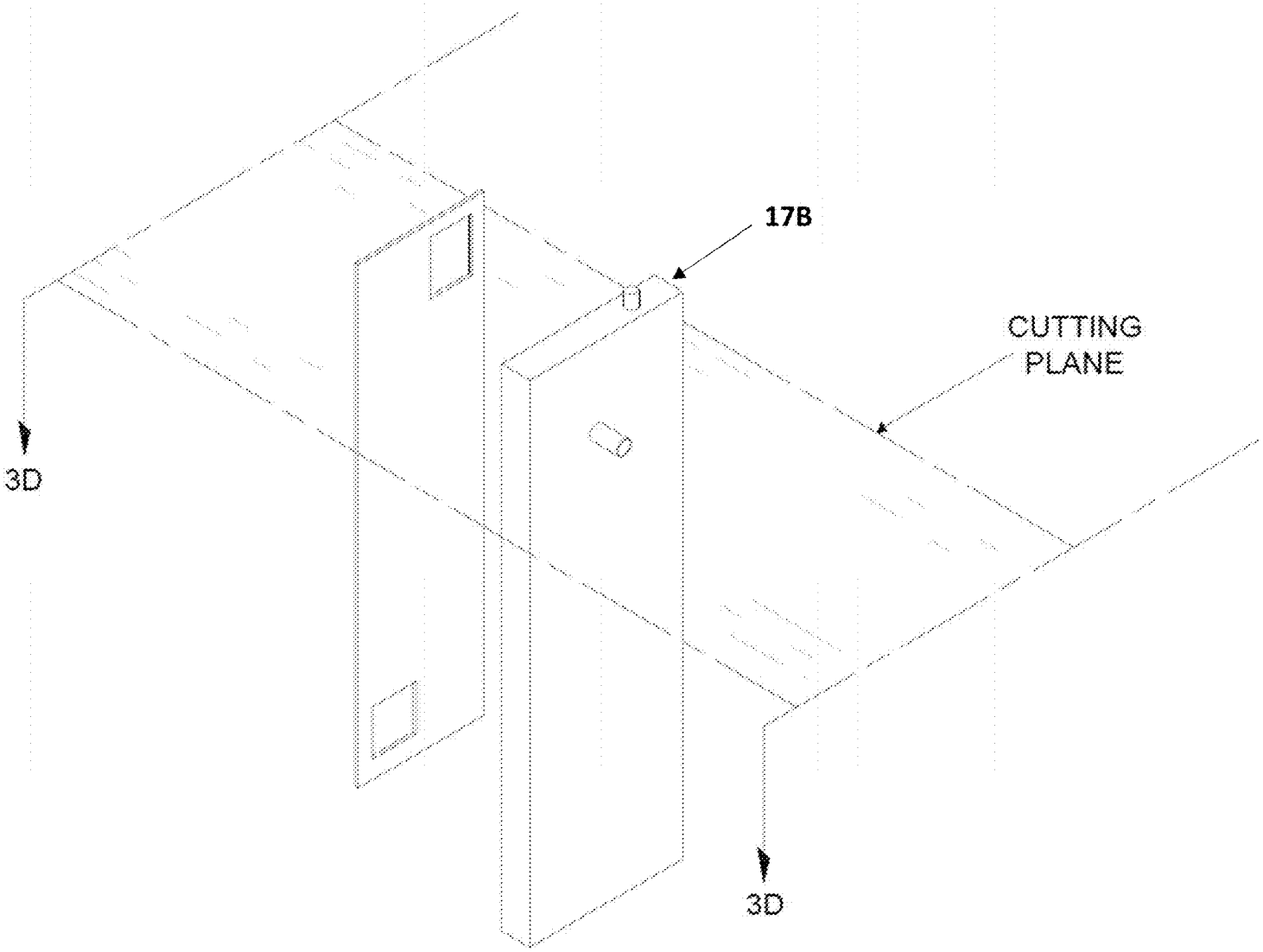
FIGURE 3C – PRIOR ART

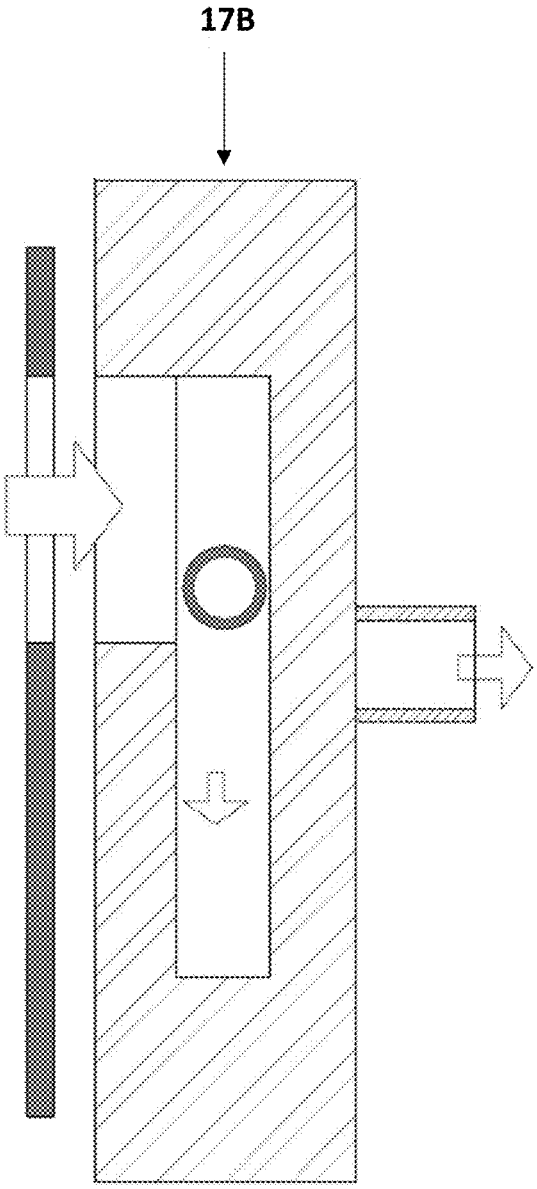
FIGURE 3D – PRIOR ART

BASIC ELEMENTS OF SHAPED END ASSEMBLY

FILTER PRESS END ASSEMBLY AND FLUID MANAGEMENT SYSTEM FOR USE IN UNIPOLAR ELECTROCHEMICAL DEVICES

CROSS-REFERENCE TO RELATED APPLICATIONS

This application claims priority to U.S. Provisional Application Ser. No. 63/076,180, filed on Sep. 9, 2020, and which is incorporated by reference.

FIELD OF THE INVENTION

This disclosure relates to novel structures for use in electrochemical devices such as electrolysers, consisting in a filter press end assembly, suitable for use in unipolar or monopolar electrolysis of an alkali aqueous solution of water which can be configured in one or more filter press arrangements.

BACKGROUND OF THE INVENTION

Electrochemical cell technology is designed such that an applied electric current induces reactions within a cell, converting available reactants into desired products. An electrolytic cell, or electrolysis cell, is one preferred method of accomplishing this conversion. Electrolysis cells require the conduction of electricity, typically direct current, from an external source to a polarized electrode. They further require conduction away from an electrode of the opposite polarity, either external to or within the electrochemical cell, to generate products.

One desirable configuration of an electrochemical cell is that of the filter press-type electrolyser. Filter press electrolyser electrochemical cells require: mechanical frames with sufficient rigidity, the ability to be connected to (and removed from) an external current source, a "current carrier" to provide a current flow path for electricity to be conducted to the electroactive area, a circulation chamber to provide space for gaseous product generation at the electroactive area, passageways that allow the input and output of reactants and products, and finally a capability to form an external seal that prevents fluids leaking from the interior of the cell to the external atmosphere.

Filter press electrolyser electrochemical cells generally come in three configurations, driven by the design of their sub-components: a bipolar cell design, a unipolar cell design, or a monopolar cell design.

Monopolar Cell Design

A "monopolar" cell design or configuration refers to an electrochemical device based upon a current carrying configuration as shown by the exemplary positive half-cell in FIG. 1B. This monopolar configuration comprises a current carrying structure, and further provides an electroactive structure of a singular polarity (either anodic or cathodic) on one side of the current carrying structure. As a result, a region of one polarity is provided on the side of the current carrying structure that possesses the electroactive structure. Current is provided into the configuration by a power source and flows in across the current carrier and to the electroactive structure. Typically, the current flows in a parallel direction to the electroactive structure. The half-cell in FIG. 1B creates the base current carrying unit for a monopolar electrochemical filter press device constructed of positive and negative (anodic and cathodic) half-cell pairs. All monopolar base current carrying units are configured electrically in parallel within a single filter press arrangement, such that one electrochemical cell is formed within a single filter press stack.

Bipolar Cell Design

The phrase "bipolar configuration" or "bipolar cell configuration" refers to an electrochemical device based upon a current carrying configuration as shown in FIG. 1C. This bipolar configuration comprises a bipolar wall, defining electroactive areas of opposite polarity on opposing sides of the current carrying structure. Regions of opposite polarity are provided on the opposing sides of the bipolar wall. Current is provided into the configuration by a power source and flows through the bipolar wall orthogonally, creating the base current carrying unit for a bipolar electrochemical filter press device. Multiple electrochemical cells within a bipolar filter press are electrically connected in series, with each individual current carrier typically comprising one anodic and one cathodic side connected by a conductive bipolar wall. The current path in bipolar cells between electroactive structures of different polarities is typically shorter than the equivalent current path in traditional monopolar designs and unipolar designs as described later.

In bipolar cells, the current must only travel through one bipolar wall to reach an electroactive structure of the opposing polarity, whereas in traditional unipolar and monopolar cells additional components are required to connect current to opposite polarity electroactive structures. A shorter current path generally creates lower resistance parameters within the conductive surfaces of a singular cell. This has traditionally led to higher voltage losses due to higher electronic resistance voltage loss, and thus lower efficiency, for unipolar and monopolar cells as compared to bipolar cells for similar current densities and similar electroactive structures.

Historically, the contribution of electronic resistance to cell voltage losses in traditional unipolar and monopolar designs presented the greatest barrier to the continued commercialization of these technologies. When choosing which direction to take electrolysis technologies in recent decades, leaders in the electrolysis field focused heavily on the advancement of "zero-gap" bipolar cell designs as they reduced the contribution of electronic resistance to cell voltage losses and consequently, for similar current densities and similar electroactive structures, improved plant energy efficiency. Zero-gap designs also allowed bipolar cells to utilize higher current densities. The focus on zero-gap bipolar technology lead to an industrial preference for bipolar technology as a whole over monopolar and unipolar technology. However, the utilization of higher current densities does not in itself lead to improved efficiency or improved plant economics. Unipolar and monopolar technologies present many complementary advantages in these areas, which will be discussed further.

In addition, in numerous bipolar filter press designs the electrolyte is shared amongst cells within the same filter press and exposed to the full potential gradient of all the individual electrolytic cells that comprise the bipolar filter press. This leads to rapid depolarization upon removal of the forward current, bypass currents during normal operation, and exposure to high potential differences leading to a need for choice of materials able to withstand this environment.

Unipolar Cell Design

A unipolar cell design or configuration refers to an electrochemical device based upon a current carrying configuration as shown by the exemplary positive half-cell in FIG. 1A. This unipolar configuration comprises a current carrying structure that provides multiple electroactive structures of the same polarity (either anodic or cathodic) on opposing sides of the current carrying structure. As a result, regions of the same universal polarity are provided on the opposing sides of the current carrying structure. Current is then provided by a power source and flows in across the current carrier and to the electroactive structures. Typically, the current flows in a parallel direction to the electroactive structures. The half-cell in FIG. 1A creates the base current carrying unit for a unipolar electrochemical filter press device constructed of positive and negative (anodic and cathodic) half-cell pairs. Like the previously described monopolar base current carrying unit, all unipolar base current carrying units are configured electrically in parallel within a single filter press arrangement, such that one electrochemical cell is formed within a single filter press stack. Unipolar designs are distinguished from monopolar designs by the presence and positioning of their electroactive area(s) among other things.

Historically, unipolar cells for alkaline water electrolysis were popularized in a "tank type" configuration. An early tank type unipolar electrolyser is described in U.S. Pat. No. 1,597,552, Electrolytic Cell, Alexander T. Stuart, 1923. A major advancement in tank type unipolar electrode design as described in U.S. Pat. No. 4,482,448, Electrode Structure for Electrolyser Cells, Bowen et al, 1981 introduced the world to large scale hydrogen production from non-fossil energy, the electrolyser design being configured for large total surfaces areas and currents of 120,000 amperes per cell. However, because of the high part count, complex assemblies, resistance within the conductive pathways of a single cell, and difficulties inherent in changing the surface area per cell, "tank type" unipolar water electrolysers, such configurations were generally replaced by comparatively more efficient "filter press type" configurations over time. However, these "tank type" designs eliminated need for mixing electrolyte between cells and the related by-pass currents and very high potential differences across multicell arrays. This generally enabled low costs materials which are stable for over 30 years of operation. These include use of low carbon steel without surface treatments or light nickel plating on carbon steel.

A double plated monopolar filter press electrolyser design was created which reduced part count and current path lengths as compared to unipolar tank type cells, while affording many of the commercial benefits of unipolar technology in U.S. Pat. No. 6,080,290 Mono-polar electrochemical system with a double electrode plate, A.T.B. Stuart et al., 1997. However, while the monopolar double plate design of U.S. Pat. No. 6,080,290 overcame the cited prior limitations of the unipolar tank type cell, the electrolyser of U.S. Pat. No. 6,080,290 was limited by the design of its "end assemblies and fluid management system" in other words, the components positioned on opposing ends of the filter press wherein the stack is physically terminated, allowing for the filter press to be clamped and interact with outside systems.

The filter press end assemblies and fluid management system in U.S. Pat. No. 6,080,290 (referred to as "end boxes") were provided as a single part tube for both external clamping and actuating mechanical forces for sealing within the filter press. The endboxes of U.S. Pat. No. 6,080,290 were intended to accommodate the separation of product gases and electrolyte within the chamber of the end box, allowing in theory for liquid electrolyte to fall and be recirculated into the filter press while product gases were removed from the end box.

The end boxes were applied on either end of each electrochemical cell stack in the electrolyser system, with the electrolyte being shared between adjacent monopolar electrochemical cell stacks before flowing into the respective end boxes, as clearly illustrated in U.S. Pat. No. 6,080,290, FIG. 14. The sharing of electrolyte between individual cells, defeated a historic advantage of tank type electrolysers wherein electrolyte was isolated between cells.

The sharing of electrolyte between adjacent monopolar filter press cell stacks presents great risks of end box material instability when applied to alkaline water electrolysis. For example, while in the alkaline water electrolyser embodiment of U.S. Pat. No. 6,080,290 is in operation, said end boxes in cathodic regions would benefit from cathodic protection. However, during start up and shut down, the presence of reverse currents within the shared electrolyte pool spanning multiple electrochemical cells would induce corrosion of even the cathodic end boxes, should they be provided from a preferred inexpensive material such as carbon steel. Further, the end boxes of U.S. Pat. No. 6,080,290 are not optimally designed such that they can be readily and cheaply nickel plated, as they comprise crevices and complex geometries being of one integral tube, making them altogether expensive to protect from corrosion, and limiting the use of cheap materials in cathode regions which may otherwise be employed in alkaline water electrolysis processes. The economics of the design of U.S. Pat. No. 6,080,290 are therefore rendered undesirably expensive in view of its end box and fluid management system design. Further, the endboxes were not themselves an integral part of the monopolar filter press, being positioned external to each electrochemical cell stack, thus consuming excess spatial footprint beyond the dimensions of the core filter press.

A bipolar filter press electrolyser module with degassing chambers, and degassed liquid passages for electrolyte return is described by Stemp in U.S. Pat. No. 8,308,917. As previously described, unipolar and monopolar single filter press stacks are equivalent to individual electrochemical cells. In contrast, bipolar filter press arrangements such as that described by Stemp in U.S. Pat. No. 8,308,917 incorporate a number of electrochemical cells longitudinally within a single filter press stack. With this construction, there are additional limitations imposed for the desired use case of large-scale alkaline water electrolysis.

As one example, there are limitations imposed by the mixing of electrolytes between electrochemical cells within the same filter press stack. The electrolyte is exposed to the summation of all voltages across each individual cell within the filter press, increasing the likelihood of corrosion currents on inexpensive materials such as carbon steel. These currents, in a reduction to practice over the device lifetime of start-up and shut down, necessitates the use of entirely corrosion proof materials such as nickel and platinum, even for the cathodic degassing chambers of the system. The necessity of applying expensive materials to cathode components due to corrosion currents inherent from the bipolar configuration increases the cost of scaling the system.

Additionally, there are practical limits on the surface area of a single bipolar cell. Practical surface area limits are imposed as the electrolytic reactants and products need to distribute throughout the bipolar electrode structure, while balancing limits in practical manufacturing techniques as well as transportation of a filter press from its point of fabrication to the operating site. Limits on practical surface area leads to lower limits on the amount of current that can flow through a bipolar filter press, as compared with a monopolar or unipolar filter press. For example, in water electrolysis processes over the past 40 years, current has ranged typically up to 10,000 amperes in a bipolar filter press as compared with 120,000 amperes in a unipolar cell. Furthermore, multiple bipolar filter presses are not practically employed in parallel with each other to increase this amperage, due to the differences in resistivity between each filter press. Therefore, for the purpose of creating large surface area electrolysis cells, bipolar cells are not practical. Without a practical method to increase total current flowing through each electrochemical cell, the use of highly cost competitive and efficient high current rectifiers cannot be realized. This is particularly relevant for large scale green hydrogen production systems over 5 MW in capacity, including systems reaching over 100 MWs in capacity. Finally, the bipolar electrolyser module of Stemp in U.S. Pat. No. 8,308,917 is optimized for a bipolar filter press of a substantially circular configuration, and could not be functionally applied to a unipolar or monopolar filter press in a substantially rectangular configuration.

FIG. 3A and FIG. 3B show a prior art embodiment of end assembly 17A for a unipolar, bipolar or monopolar electrolyser filter press. End assembly 17A does not include an end plate assembly. Structurally, it must be able to bear the forces applied in the center of the filter press while also tolerating external pressure differential. This results in a more intensive design.

FIG. 3C and FIG. 3D show another prior art embodiment of end assembly 17B for a unipolar, bipolar or monopolar electrolyser filter press. End assembly 17B includes a large block with a cavity for liquid to pass through. However, this cavity is difficult to fabricate due to its placement within the design. The unitary construction of the end piece makes nickel platting difficult, due to the shape and the internal chambers. Furthermore, the unitary construction makes it difficult to add mechanical support members, and internal tubing, and also increases the difficulty in maintenance. In addition, the unitary construction of this end assembly does not allow for separate sealing flanges, and has limitations to size and shapes.

By the year 2020, the cost of implementing renewable forms of electricity production through technologies such as wind turbines and photovoltaics has dramatically fallen from historical levels. Rather than being one of the most expensive sources of electricity, as they were in the 1970's and 1980's, photovoltaics and wind turbines are now some of the world's lowest-cost electricity sources, and are indigenous to every country across the globe. Integrating these renewable energy technologies with large scale alkaline water electrolysis cells can produce renewably made hydrogen at historically low costs. These costs in many cases can be lower than the cost of hydrogen produced from fossil fuels and have the potential to enable the long-term replacement of fossil energy with renewable energy.

However, to replace fossil-based hydrogen with renewable-based hydrogen, water electrolysers are required on the order of 100 to 1000 times larger than what has generally been used in industry over the past 20 years. For example, one large-scale ammonia production facility, which would source its hydrogen from renewable energy sources and water electrolysis units, would need approximately 2,000 MW of power. Therefore, the water electrolysers are required to have, among other features, very high individual cell currents (for example 50,000 to 500,000 amperes) in order to minimize the quantity of small-scale power conditioning systems required to provide DC current to the electrolysers.

Looking to other electrolysis fields, high current electrolysis technology with a minimum number of high current power conditioning systems represents the state of the art for large power electrochemical processes, such as electrolysis for chlorine production and aluminium production.

Therefore, an end assembly and fluid management system for a unipolar filter press alkaline water electrolyser that can be readily employed for large scale alkaline water electrolysis from inexpensive materials and at low cost to manufacture would be highly desirable.

SUMMARY OF THE INVENTION

The present disclosure provides an end assembly for use in a unipolar filter press electrolyser, where the unipolar filter press electrolyser has a plurality of filter press frame components arranged to form a filter press stack. The end assembly of the unipolar filter press electrolyser includes an end plate component having at least two apertures defined therein, the at least two apertures being alignable with channels formed in the filter press frame components of the plurality when the end assembly is operatively connected to the filter press stack. The at least two apertures include a first aperture configured to receive a stream of liquid electrolyte and gases from the filter press stack, and a second aperture configured to receive a stream of recirculated liquid electrolyte. The end assembly further includes a first gasket member positionable between the end plate component and one of the filter press frame components of the plurality. In addition, the end assembly includes an end clamp configured to apply a clamping force on the end plate component to securely retain the filter press stack. The end clamp has a body formed with a hollow, and includes at least one gas offtake port configured to extract gases from the stream of liquid electrolyte and gases flowing from the first aperture and discharge the extracted gases out of the unipolar filter press electrolyser. The hollow of the body of the end clamp redirects a stream of liquid electrolyte substantially free of gases toward the second aperture for recirculation in the filter press stack. The end assembly also includes a second gasket member positionable between the end plate component and the end clamp, where the gasket is configured to provide a seal for isolating the internal pressure within the filter press stack from external atmospheric pressure.

Further to the above embodiment, the first aperture is disposed adjacent to the upper end of the end plate component and the second aperture disposed adjacent to the lower end of the end plate component.

In alternative embodiments, the first and second apertures are disposed diagonally relative to each other.

In certain embodiments, the at least two apertures of the end plate component include a third aperture disposed side-by-side the second aperture adjacent to the lower end of the end plate component.

In alternative embodiments, the end plate component includes a pair of opposite faces and first and second mechanical support members attached to one of the faces of the end plate component.

Further to the above embodiments, the first mechanical support member is positioned near the upper end of the end plate component to reinforce an area around the first aperture and the second mechanical support member is positioned near the lower end of the end plate component to reinforce an area around the second aperture.

Each mechanical support member includes a horizontal flange portion and a vertical flange portion fixed to each other to form a generally T-shaped structure.

Further to the above embodiments, the vertical flange portion of the first mechanical support member extends from the horizontal flange portion of the first mechanical support member towards the top end of the end plate component.

In an alternative embodiment, the vertical flange portion of the second mechanical support member extends from the horizontal flange portion of the second mechanical support member towards the bottom end of the end plate component.

In certain embodiments, the horizontal flange portion has a semi-circular profile.

In other embodiments, the vertical flange portion has a quarter-circular profile.

In alternative embodiments, the horizontal flange portion and the vertical flange portion each have through-holes defined therein for the flow of gasses and liquids.

In other embodiments, the first aperture is generally square and is defined by a pair of opposed left and right vertical inner edges and opposed upper and lower horizontal inner edges. In addition, a part of the horizontal flange portion of the first mechanical support member runs adjacent to the lower horizontal inner edge of the first aperture, and the vertical flange portion of the first mechanical support member runs adjacent to one of vertical inner edges of the first aperture.

The second aperture is generally square and is defined by a pair of opposed left and right vertical inner edges and opposed upper and lower horizontal inner edges. In addition, a part of the horizontal flange portion of the second mechanical support member runs adjacent to the upper horizontal inner edge of the second aperture and the vertical flange portion of the second mechanical support member runs adjacent to one of vertical inner edges of the second aperture.

In alternative embodiments, each of the mechanical support members includes a horizontal truss portion and a vertical truss portion fixed to each other to form a generally T-shaped structure.

Further to the above embodiments, each of the horizontal and vertical truss portions are trapezoidal trusses.

Alternatively, each of the horizontal and vertical truss portions are triangular trusses.

In addition to the above embodiments, the end plate component includes a pair of opposite faces and at least one mechanical support member attached to one of the faces of the end plate component.

In certain embodiments, the end clamp has an outer surface, an inner surface and a plurality of cooling fins protruding from the outer surface of the end clamp.

The cooling fins extend longitudinally along the outer surface of the end clamp.

In addition to the above embodiments, the hollow accommodates mechanical support members attached to a surface of the end plate component.

Further to the above, the body of the end clamp has a semi-circular profile when viewed from the top.

Alternatively, the body of the end clamp has a substantially rectangular profile when viewed from the top.

The end plate component is fabricated from a corrosion resistant material such as steel, titanium, Hastelloy®, stainless steel, or nickel.

In other embodiments, the end plate component is further coated in nickel plating for corrosion resistance.

The end clamp is fabricated from a corrosion resistant material such as steel, titanium, Hastelloy®, stainless steel, nickel, or polymer.

In other embodiments, the end clamp is further coated in nickel plating for corrosion resistance.

In other embodiments, the end clamp is a plate.

Where the end clamp is a plate, the end assembly may further include a plurality of rigid hollow frame component and a plurality of intermediate gasket members, where one intermediate gasket member of the plurality of intermediate gasket members is positionable between adjacent rigid hollow frame components of the plurality of rigid hollow frame components. In addition, the end assembly may also include a third gasket member, where the third gasket member is coupled to the end clamp, where the plurality of rigid hollow frame components and the plurality of intermediate gasket members are disposed between the second gasket member and the third gasket member providing a hollow therein to accommodate mechanical support members attached to a surface of the end plate component.

In alternative embodiments, the end clamp also includes at least one accessory port for connecting accessories, including analytic and control accessories, accessories configured for reactant additions, accessories configured to purge gases and accessories configured to drain the hollow.

In other embodiments, the end clamp has an outer surface, an inner surface and the at least one gas offtake port located on the outer surface of the end clamp, where the at least one gas offtake port extends outwardly from and substantially perpendicular to the outer surface of the end clamp.

Further to the above embodiments, the at least one gas offtake port is disposed adjacent to the upper end of the end clamp.

Further to the above embodiments, the at least one gas offtake port discharges either oxygen gas or hydrogen gas.

In alternate embodiments, the end clamp has a top portion and the at least one gas offtake port extends from the top portion of the end clamp.

In other embodiments, the first gasket member has at least two apertures defined therein, the at least two apertures being alignable with channels formed in the filter press frame components of the plurality when the end assembly is operatively connected to the filter press stack.

In certain embodiments, the second gasket member is a rectangular frame surrounding a rectangular opening.

Further to the above embodiments, the end clamp includes a flange surrounding the body of the end clamp for facilitating connection to the filter press stack and for applying pressure against the filter press stack to create a seal.

Further to the above embodiments, the flange also has a plurality of holes for receiving tie rods for clamping the end clamp to the filter press stack.

In addition to the above embodiments, the end clamp includes a plurality of lateral struts spanning the hollow between the flange of the end clamp.

Further to the above embodiments, the second gasket member is alignable to the flange of the end clamp.

In addition, the thickness of the flange is greater than the thickness of the body of the end clamp.

Further to the above embodiments, the plurality of rigid hollow frame components has a plurality of lateral struts running between opposing edges of each rigid hollow frame component, where the plurality of lateral struts are to reinforce the rigidity of the plurality of rigid hollow frame components.

In addition to the above embodiments, the plurality of lateral struts include at least three lateral struts.

In other embodiments, the end clamp has a plurality of reinforcing gussets to further improve the rigidity of the end clamp.

The present disclosure provides a unipolar filter press electrolyser including a plurality of filter press frame components arranged to form a filter press stack, the filter press stack having a first end and a second end, and a first and a second end assembly, the first end assembly for mounting to the first end of the filter press stack, the second end assembly for mounting to the second end of the filter press stack. Each end assembly includes an end plate component having at least two apertures defined therein, the at least two apertures being alignable with channels formed in the filter press frame components of the plurality when the end assembly is operatively connected to the filter press stack, the at least two apertures include a first aperture configured to receive a stream of liquid electrolyte and gases from the filter press stack, and a second aperture configured to receive a stream of recirculated liquid electrolyte. The end assembly also includes a first gasket member positionable between the end plate component and one of the filter press frame components of the plurality, and an end clamp configured to apply a clamping force on the end plate component to securely retain the filter press stack, the end clamp having a body formed with a hollow, and at least one gas offtake port, configured to extract gases from the stream of liquid electrolyte and gases flowing from the first aperture and discharge the extracted gases out of the unipolar filter press electrolyser, where the hollow of the body of the end clamp is configured to redirect a stream of liquid electrolyte substantially free of gases toward the second aperture for recirculation in the filter press stack. The end assembly further includes a second gasket member positionable between the end plate component and the end clamp, the gasket configured to provide a seal for isolating the internal pressure within the filter press stack from external atmospheric pressure. The unipolar filter press electrolyser also includes a plurality of masking components positionable between the end assemblies and the filter press stack.

Further to the above embodiment, each end assembly further includes a plurality of rigid hollow frame components, and a plurality of intermediate gasket members, where one intermediate gasket member of the plurality of intermediate gasket members is positionable between adjacent rigid hollow frame components of the plurality of rigid hollow frame components. Each end assembly also includes a third gasket member, the third gasket member coupled to the end clamp, wherein the plurality of rigid hollow frame components and the plurality of intermediate gasket members are disposed between the second gasket member and the third gasket member providing a hollow therein to accommodate mechanical support members attached to a surface of the end plate component.

In alternate embodiments, each end clamp of the first and second end assembly has an outer surface, an inner surface and the at least one gas offtake port located on the outer surface of the end clamp, where the gas offtake port of the first end assembly is configured to discharge oxygen gas, and the gas offtake port of the second end assembly is configured to discharge hydrogen gas.

When the unipolar filter press electrolyser is in operation, the stream of electrolyte and gases received in the first aperture defined in the end plate component of the first end assembly is a stream of oxygen and an anolyte, and the stream of recirculated liquid electrolyte received in the second aperture defined in the end plate component of the first end assembly is a stream of the anolyte. In addition, the stream of electrolyte and gases received in the first aperture defined in the end plate component of the second end assembly is a stream of hydrogen and a catholyte, and the stream of recirculated liquid electrolyte received in the second aperture defined in the end plate component of the second end assembly is a stream of the catholyte.

BRIEF DESCRIPTION OF THE SEVERAL VIEWS OF THE DRAWINGS

FIG. 3A shows a perspective view of a prior art configuration of an end assembly for a unipolar electrolyser press.

FIG. 3B shows an exploded cross-sectional view of the end assembly shown in FIG. 3A taken along line "3B-3B".

FIG. 3C shows a perspective view of another prior art configuration of an end assembly for a unipolar electrolyser filter press.

FIG. 3D shows an exploded cross-sectional view of the end assembly shown in FIG. 3C taken along line "3D-3D".

DETAILED DESCRIPTION OF THE EMBODIMENTS OF THE INVENTION

Figure 1A:
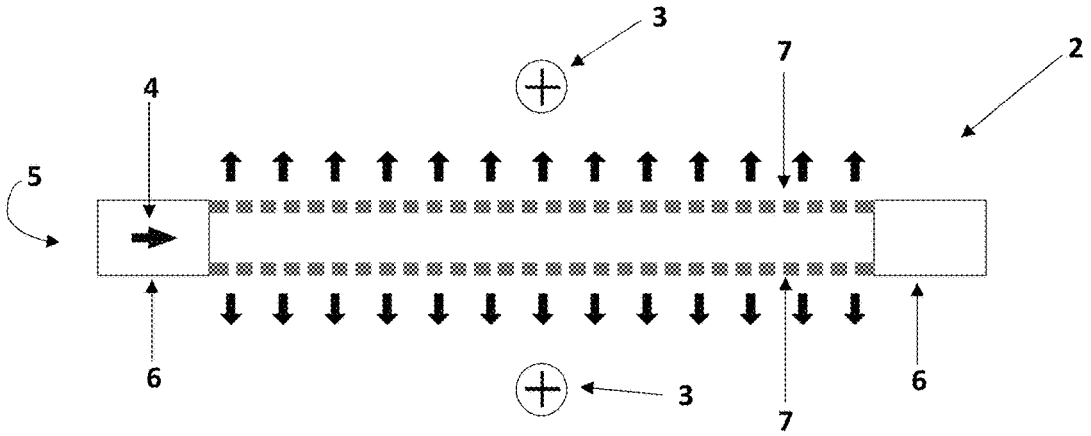
FIG. 1A shows a schematic lateral cross-sectional view of a base current carrying half-cell unit of a unipolar electrolyser filter press, comprising electroactive structures of the same polarity on opposing sides of the current carrier configured electrically in parallel.

Various embodiments and aspects of the disclosure will be described with reference to details discussed below. The following description and drawings are illustrative of the disclosure and are not to be construed as limiting the disclosure. The figures are not to scale. The dimensions of the apertures in the figures are non-limiting and can be adjusted by the designer for flow and pressure management. Numerous specific details are described to provide a thorough understanding of various embodiments of the present disclosure. However, in certain instances, well-known or conventional details are not described to provide a concise discussion of embodiments of the present disclosure. As used herein, the terms, "comprises" and "comprising" are to be construed as being inclusive and open ended, and not exclusive. Specifically, when used in the specification and claims, the terms "comprise" and "comprising" and variations thereof mean the specified features, steps or components are included. These terms are not to be interpreted to exclude the presence of other features, steps, or components.

As used herein, the term "exemplary" means "serving as an example, instance, or illustration," and should not be construed as preferred or advantageous over other configurations disclosed herein.

As used herein, the terms "about" and "approximately" are meant to cover variations that may exist in the upper and lower limits of the ranges of values, such as variations in properties, parameters, and dimensions. In one non-limiting example, the terms "about" and "approximately" mean plus or minus 10 percent or less.

As used herein, the terms "generally" and "essentially" are meant to refer to the general overall physical and geometric appearance of a feature and should not be construed as preferred or advantageous over other configurations disclosed herein.

As used herein, the term "filter press" is meant to refer to, but not exclusively, the general configuration of the assembled unipolar electrochemical device in a filter press configuration, and may also be referred to herein as a stacked array of combined current carriers, circulation chambers and rigid support frames ("CCFs").

PARTS LIST

2—Half-cell unit of a unipolar electrolyser filter press

3—Positive electroactive region.

4—Current entering from the side of the configuration, and travelling in parallel with the surface of electroactive structure 7.

5—Power input into the cell (also referred to herein as a power source).

6—Current carrier.

7—Electrically conductive mesh, perforated or slotted sheet, expanded sheet, screens, woven mesh or similar appropriate planar configuration thereof forming the anodic electroactive structure and designated as an anodic mesh with the positive sign (also referred to herein as electroactive structures).

8—Conductive bipolar wall.

9—Stacked array of CCFs.

10—Half-cell unit of a monopolar electrolyser filter press.

11—Current entering orthogonally to the conductive bipolar wall and traveling orthogonally through it.

12—Negative electroactive region.

13—Half-cell with a basic bipolar current carrying configuration.

14A—Oxygen gas.

14B—Oxygen gas header.

15A—Hydrogen gas.

15B—Hydrogen gas header.

16—Unipolar filter press electrolyser for alkaline water electrolysis with end assemblies on either side (also referred to herein as unipolar filter press electrolyser assembly, electrochemical device, battery or fuel cell).

17A—Prior art embodiment of an end assembly for a unipolar, bipolar or monopolar filter press electrolyser for alkaline water electrolysis.

17B—Prior art embodiment of an end assembly for a unipolar or monopolar filter press electrolyser for alkaline water electrolysis.

18—An end assembly for a unipolar filter press electrolyser for alkaline water electrolysis including a planar end clamping element, an electrolyte returns chamber, a substantially rigid inner end plate structural element and non-limiting gaskets between the end clamping element and the substantially rigid inner end plate structural element.

45—First edge of end plate component 50A.

46—Second edge of end plate component 50A.

47—Third edge of end plate component 50A.

48—Fourth edge of end plate component 50A.

50A—Inner end plate with semi-circular reinforcement flanges as mechanical support members (also referred to herein as end plate component).

50B—Inner end plate with arched members as mechanical support members (also referred to herein as end plate component).

50C—Inner end plate with trapezoidal trusses as mechanical support members (also referred to herein as end plate component).

50D—Inner end plate with triangular trusses as mechanical support members (also referred to herein as end plate component).

50E—Rigid inner end plate without mechanical support members (also referred to herein as end plate component).

51—Hollow space inside end clamp.

52—aperture on end plate component.

54—upper right aperture in end plate reinforcement component.

58—Upper horizontal mechanical support component.

62—Upper vertical mechanical support component.

66—Perforated holes in mechanical support trusses (also referred to herein a through-holes).

70—Lower left aperture in end plate component.

71—Lower right aperture in end plate component.

74—Lower horizontal mechanical support component.

78—Lower vertical mechanical support component.

80—Filter press plate (also referred to herein as filter press frame component or as a CCF).

82—Simplified end clamping element (also referred to as an end clamp).

82A—Rectangular end clamping element (also referred to as end clamp).

82B—Rectangular end clamping element with vertical fins (also referred to as end clamp).

86—Tie rod hole.

90—Gas offtake port.

Figure 5A:
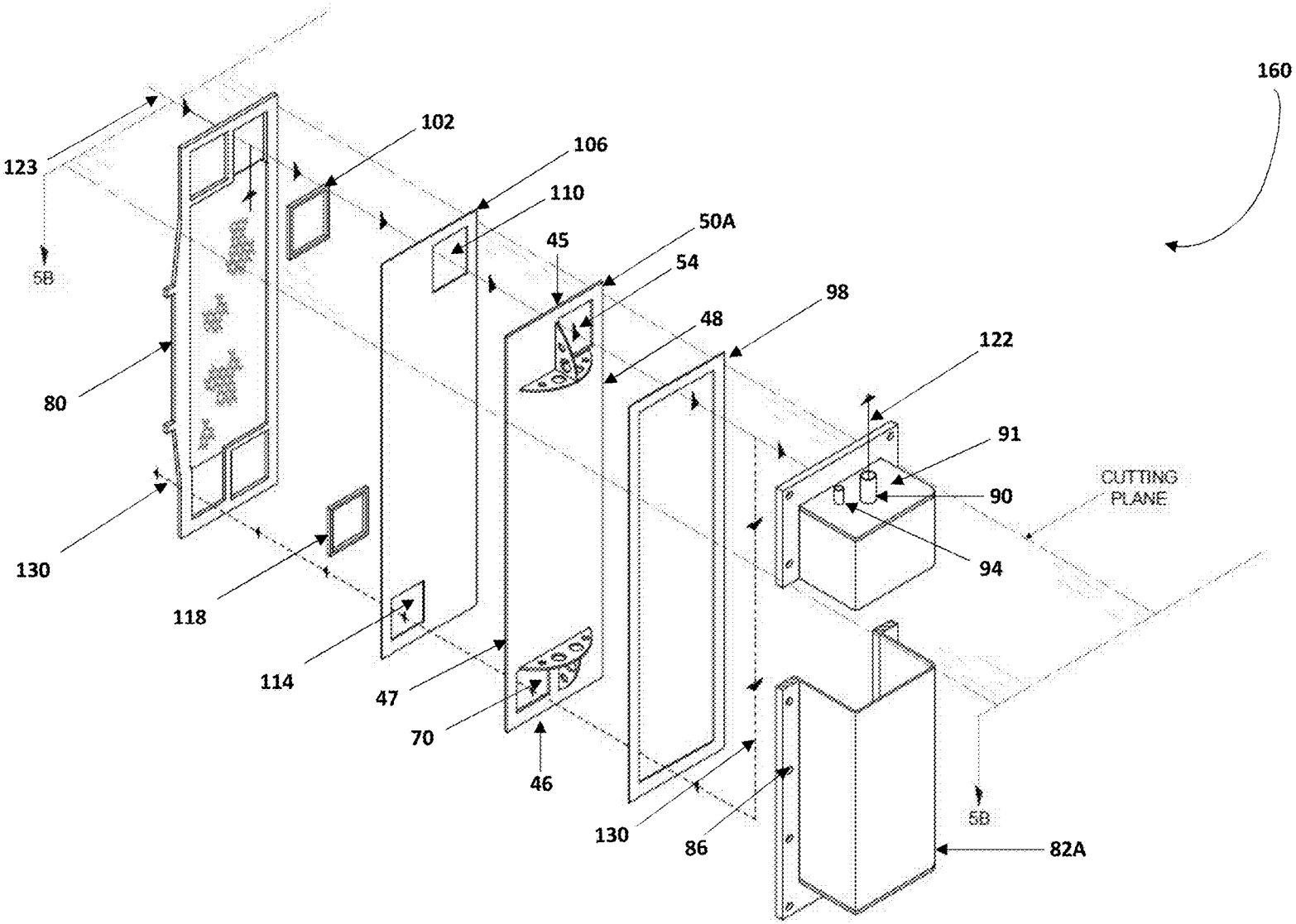
FIG. 5A shows an exploded front perspective view of an end assembly of a unipolar filter press electrolyser according to an embodiment of the invention comprising a filter press frame component, an end plate component, a substantially rectangular end clamping component, and several gasket and masking components for sealing purposes, with arrows showing the direction of product gas off-take and liquid electrolyte recirculation.
Figure 7A:
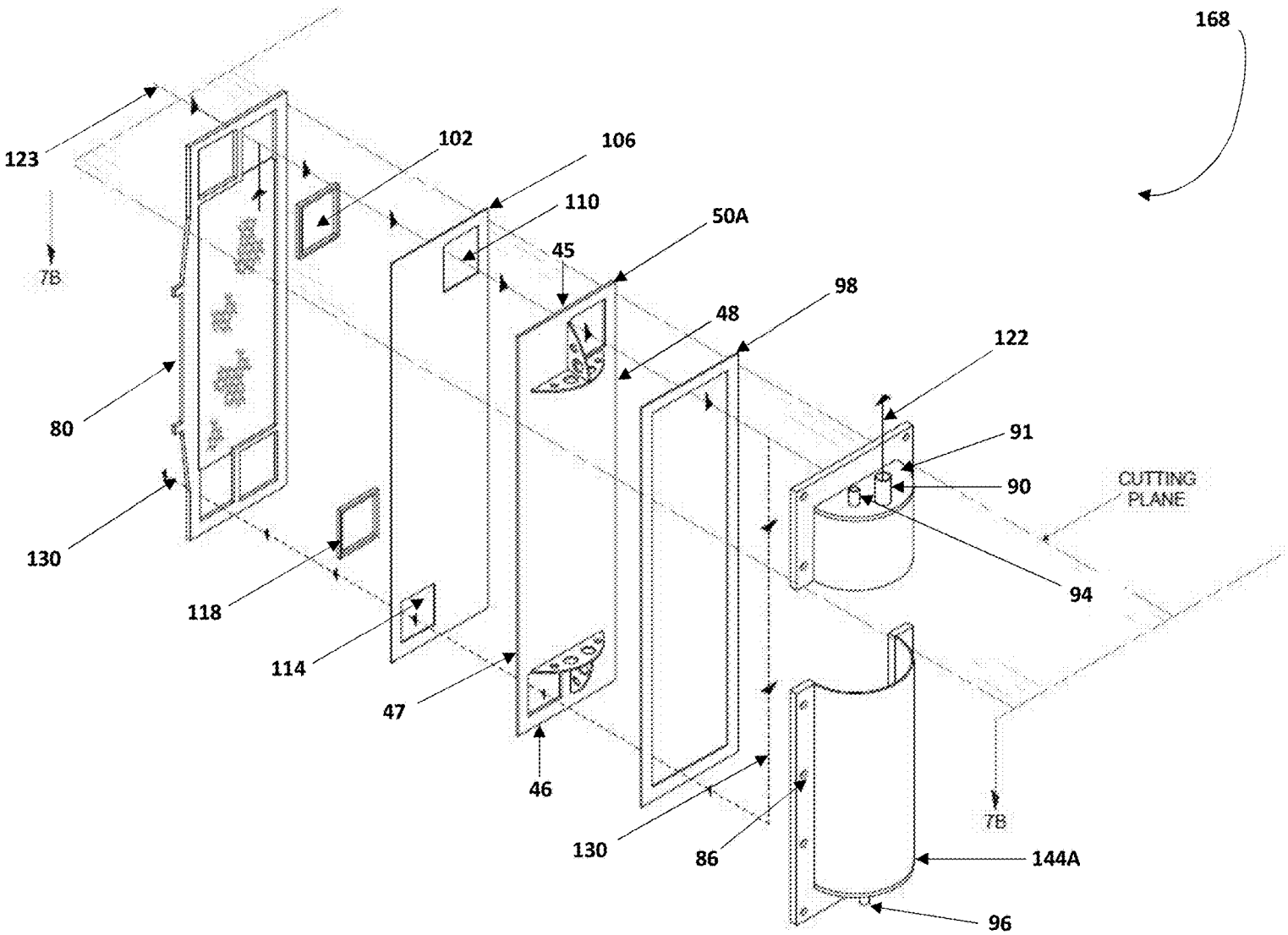
FIG. 7A shows an exploded front perspective view of an end of a unipolar filter press electrolyser according to alternative embodiment to that illustrated in FIG. 5A wherein an end clamping component having a substantially semi-circular profile is provided.

91—Top flat surface of end clamp as depicted in FIG. 5A and FIG. 7A.

92—Bottom flat surface of end clamp as depicted in FIG. 7A.

94—First accessory port.

96—Second accessory port.

98—Sealing gasket.

102—Upper left mask (also referred to generically herein as masking component).

104—Upper right mask (also referred to generically herein as masking component).

106—Full-faced gasket

110—Upper right aperture of the full-faced gasket shown in FIGS. 7A, 7C, 7D and 7E.

112—Upper left aperture of the full-faced gasket shown in FIGS. 9A, 9B, 10A and 10B.

Figure 7B:
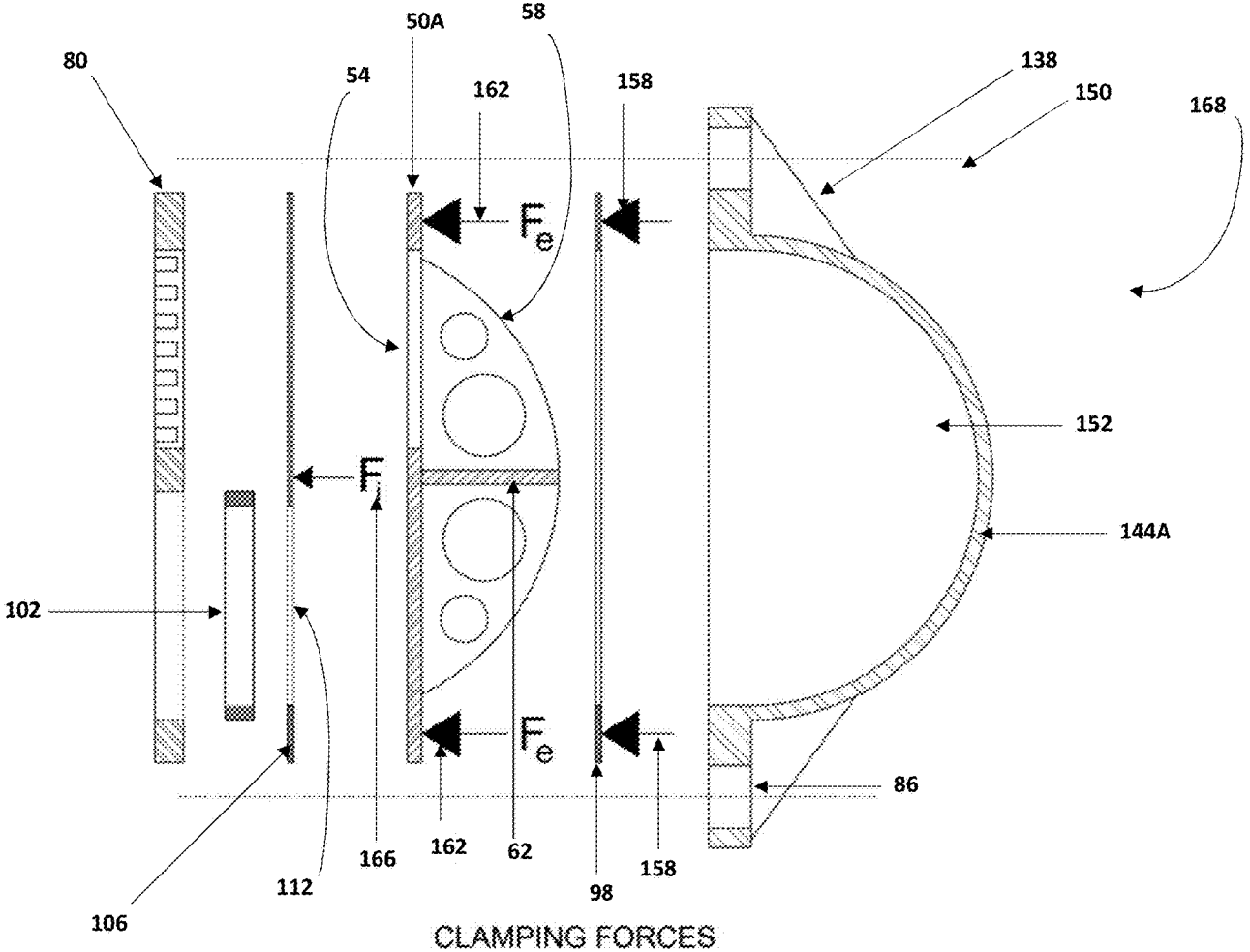
FIG. 7B shows a cross-sectional view of the end assembly depicted in FIG. 7A taking along line "7B-7B" with arrows included to indicate the directionality of external and internal forces applied on the end assembly when assembled and clamped as a filter press.
Figure 7C:
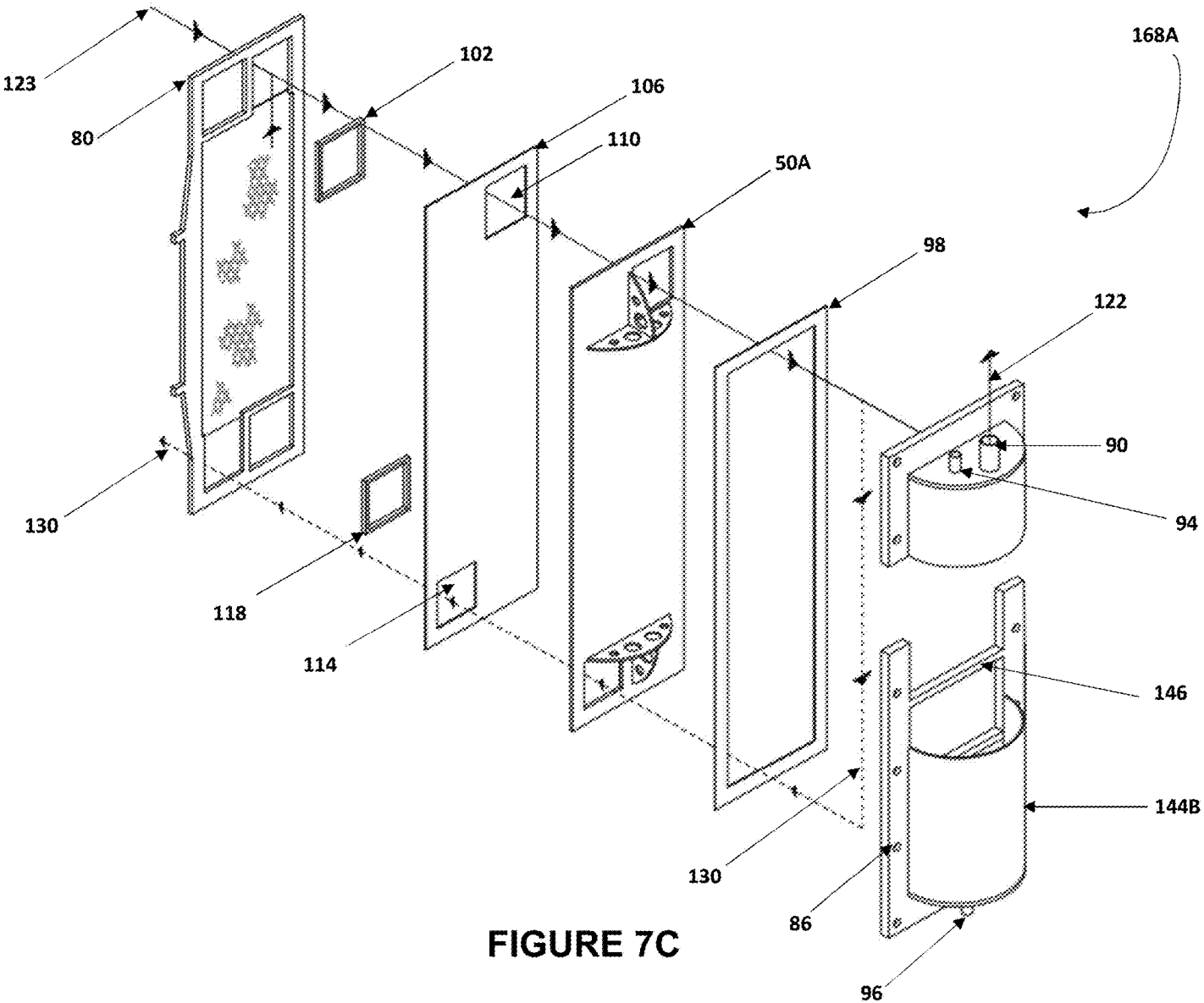
FIG. 7C shows an exploded front perspective view of an end assembly of a unipolar filter press electrolyser according to alternative embodiment with the end assembly being generally similar to that illustrated in FIG. 7A except that the end clamping component t further includes lateral cross struts for mechanical rigidity.
Figure 7D:
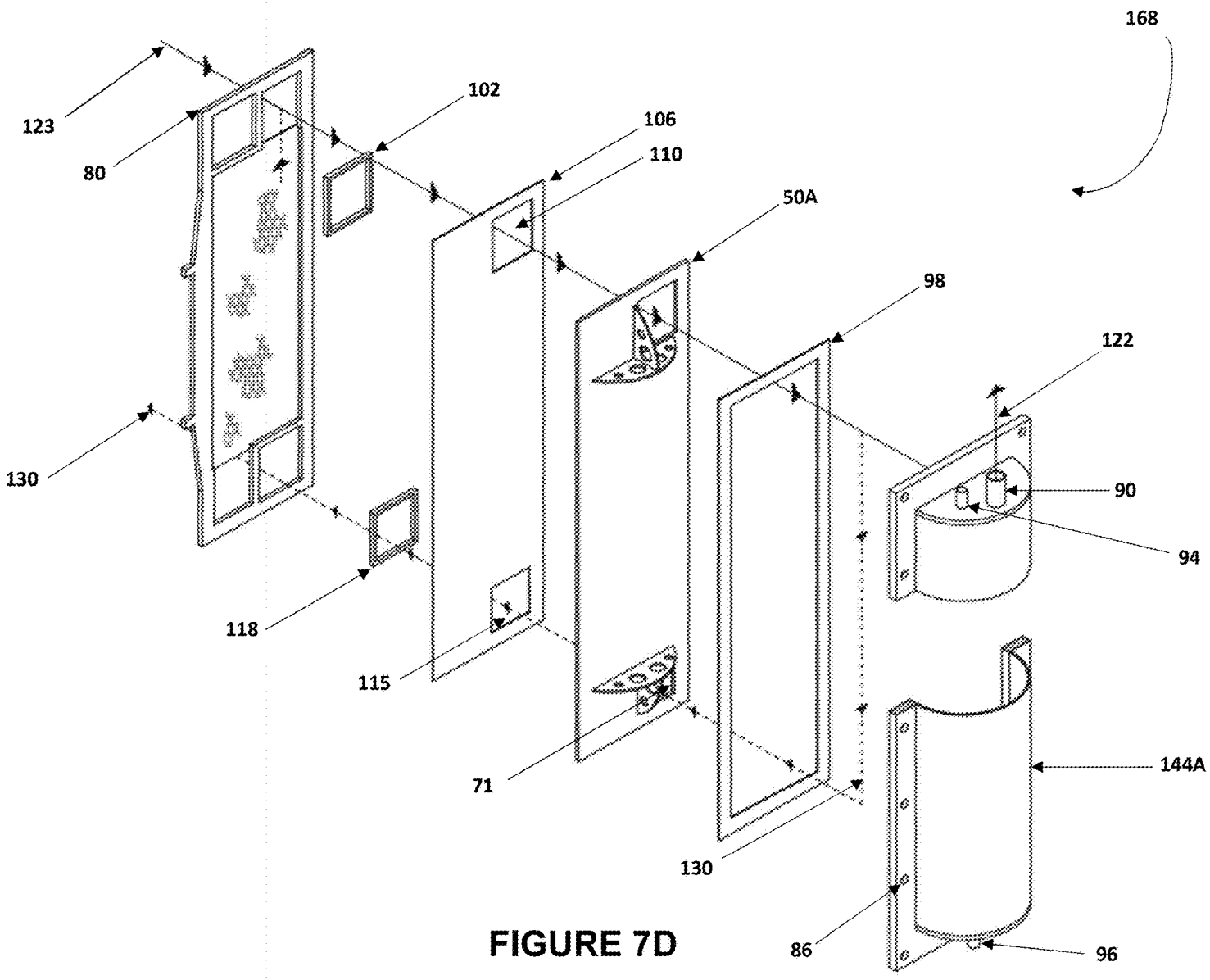
FIG. 7D shows an exploded front perspective view of an end assembly of a unipolar filter press electrolyser according to alternative embodiment with the end assembly being generally similar to that illustrated in FIG. 7A except that the lower aperture in the inner end plate component is arranged to allow for the degassed electrolyte to be fed completely into the electrodes of opposing polarization.
Figure 7E:
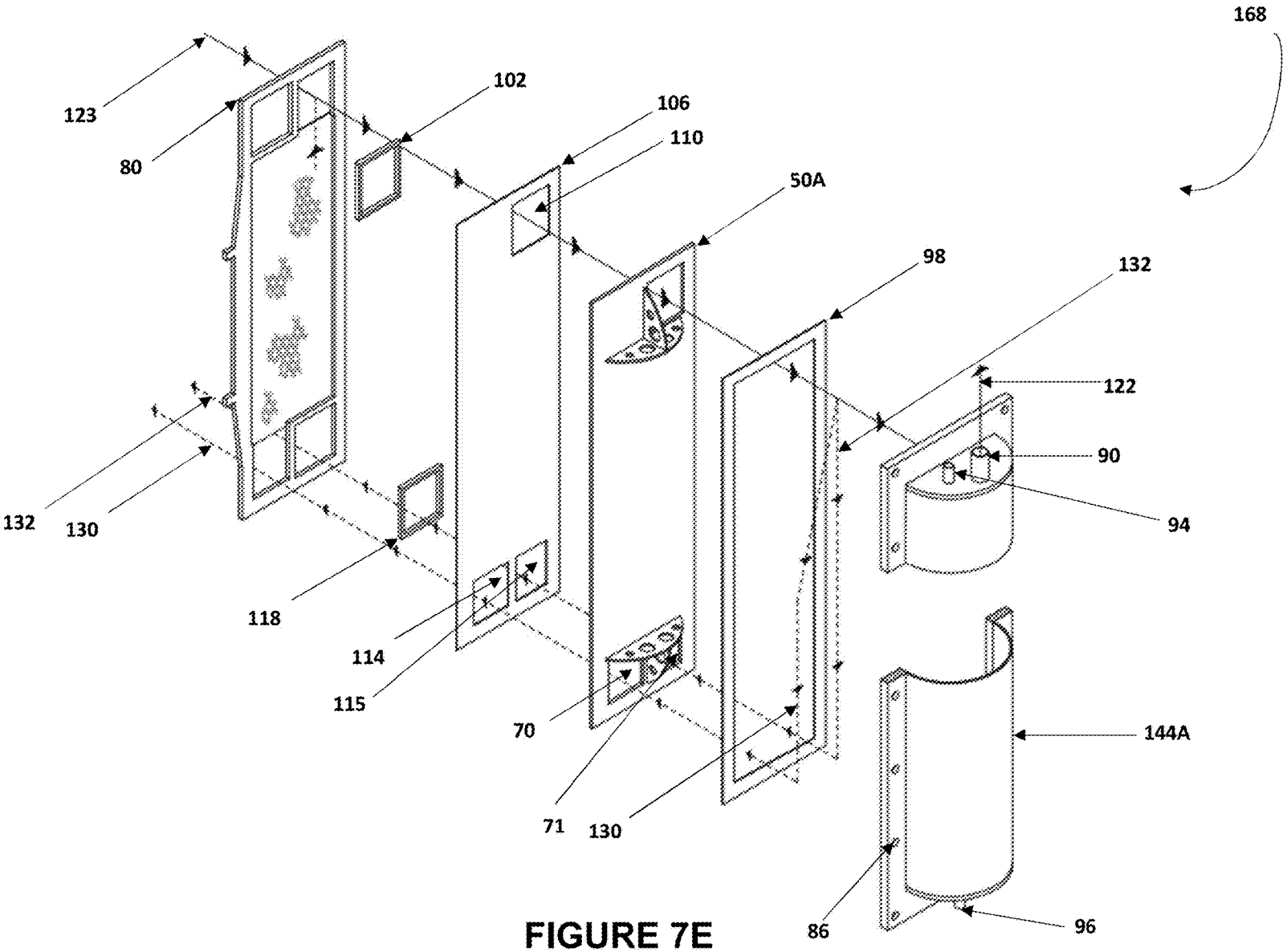
FIG. 7E shows an exploded front perspective view of an end assembly of a unipolar filter press electrolyser according to alternative embodiment with the end assembly being generally similar to that illustrated in FIG. 7A except that two apertures in the inner end plate component are provided to allow for constant mixing of both anolyte and catholyte into the both lower electrolyte chambers of the filer press.

114—Lower left aperture of the full-faced gasket shown in FIGS. 7A, 7C and 7E.

115—Lower right aperture of the full-faced gasket shown in FIGS. 7D, 7E, 9A, 9B, 10A and 10B.

118—Lower right mask (also referred to generically herein as masking component).

120—Lower left mask (also referred to generically herein as masking component).

122—Direction of stream of gas exiting the end assembly.

130—Lower left electrolyte streams.

132—Lower right electrolyte streams.

138—Reinforcing gusset.

144A—Clamping element with a semi-circular profile (also referred to herein as end clamp or semi-circular end clamp).

144B—Clamping element with semi-circular profile and lateral struts (also referred to herein as end clamp or semi-circular end clamp).

144C—Clamping element with vertical fins (also referred to herein as end clamp or semi-circular end clamp).

146—Transversal (or lateral) struts (also referred to herein as lateral cross struts).

150—Axis of tie rod.

152—Empty space in semi-circular end clamp.

154—Empty space in rectangular end clamp.

158—Clamping force from the end clamp (also referred to as external force).

160—End assembly with substantially rectangular end clamp.

162—Force on peripheral segments of gasket (also referred to as external force or $F_e$).

166—Pressure applied on the internal gasket element (also referred to as internal force or $F_i$).

168—End assembly with semi-circular end clamp.

168A—End assembly with lateral struts (Semi-circular end clamp).

170—Pressure of product gas 1 (ie. hydrogen or oxygen) (also referred to herein as $P_1$).

174—Pressure of product gas 2 (ie. hydrogen or oxygen) (also referred to herein as $P_2$).

178—Pressure applied on the external gasket element (also referred to herein as $P_{Ge}$).

182—Atmospheric pressure (also referred to herein as $P_A$).

184—Vertical fins on end clamps 82B, 144C and 208A.

186—Pressure of product gas (ie. hydrogen or oxygen) within the filter press (also referred to herein as $P_i$).

198—End assembly with mechanical support members on the end plate component and hollow rigid frames between the end plate component and the end clamp.

200—Notch in hollow rigid frame.

204—Hollow rigid frame.

208—Flat end clamping plate (also referred to herein as end clamp).

208A—Flat end clamp with vertical fins (also referred to herein as end clamp).

212—Gas offtake port.

214—Accessory port.

216—Direction of exiting gas from end clamp.

218—Direction of liquid recirculating back into filter press/stacked array of CCFs.

220—Direction of liquid heading to end assembly.

224—Intake port (also referred to herein as accessory port).

228—End assembly with rigid inner end plate and hollow rigid frames.

228A—End assembly with rigid inner end plate and hollow rigid frames with lateral cross struts.

240—Rigid end plate without mechanical support members.

244—Upper left aperture in rigid inner end plate component.

248—Lower right aperture in rigid inner end plate component.

252—Lateral cross struts in hollow rigid frame.

304—Electrochemical cell

The embodiments of the present invention disclosed herein aim to solve at least one of the problems discussed above by providing an end assembly and fluid management system for a unipolar filter press electrolyser assembly that can be built and assembled at a low cost to manufacture. This is accomplished through designing the end assembly to withstand pressures, optimal material usage and ensuring ease of construction and corrosion coating.

Figure 2:
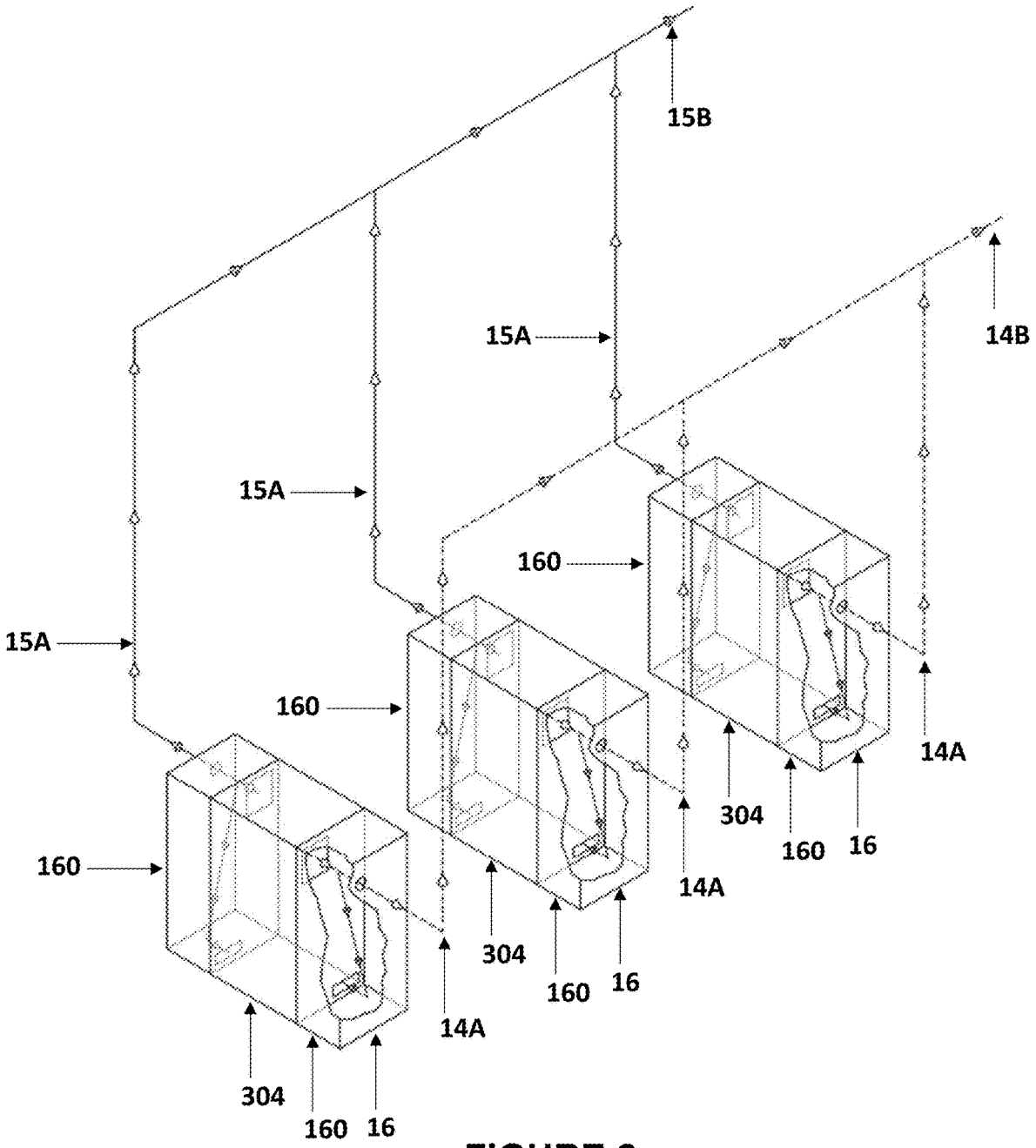
FIG. 2 shows a simplified perspective schematic view of an end assembly of a unipolar electrolyser filter press comprising three electrochemical cells each having an inner end plate component and an end clamping component, such that charged fluids do not mix between electrochemical cells.

FIG. 2 depicts three unipolar filter press electrolyser assemblies 16. (Unipolar filter press electrolyser assemblies 16 are referred to herein generically as unipolar filter press electrolyser assembly 16 and collectively as unipolar filter press electrolyser assemblies 16. This nomenclature is used elsewhere herein.)

Unipolar filter press electrolyser assembly 16 may be utilized for a variety of electrochemical processes. Preferred examples of processes include: alkaline water electrolysis, and chlorine production through chlor alkali and sodium chlorate electrolysis. In all such electrolysis processes, electrolyte exposed to a cathode in a cathodically polarized region of the cell is referred to as "catholyte", whereas the electrolyte exposed to an anode in the anodically polarized region of the cell is referred to as "anolyte".

For example, the current embodiment of unipolar filter press electrolyser assembly 16 in FIG. 2 depicts alkaline water electrolysis. In alkaline water electrolysis, the starting electrolyte is comprised of a highly basic sodium hydroxide or potassium hydroxide solution. End assembly 160 separates oxygen 14A from the anolyte in one end assembly 160 and hydrogen 15A from the catholyte in the other end assembly 160. The anode product created is oxygen gas 14A, and the cathode product created is hydrogen gas 15A. The end assembly 160 that separates oxygen 14A from the anolyte and the end assembly 160 that separates hydrogen 15A from the catholyte are generally the same and are laid out in a mirror arrangement one relative to the other at either end of the filter press stack. In the current embodiment, the two end assemblies 160 are depicted as being of the same size, however it will occur to a person skilled in the art that the two end assemblies 160 on unipolar filter press electrolyser 16 may be different sizes and have different dimensions. Catholyte and any additional reactants required are fed into the anodic end of unipolar filter press electrolyser assembly 16, and anolyte and any additional reactants required are fed into the anodic end of unipolar filter press electrolyser assembly 16, such that target concentrations are achieved. As can be seen, the anode product of oxygen gas 14A leaves one end of unipolar filter press electrolyser assembly 16 through an end assembly 160 via a gas outtake port. Similarly the cathode product of hydrogen gas 15A leaves unipolar filter press electrolyser assembly 16 through an end assembly 160 through a gas outtake port to hydrogen gas header 15B. End assembly 160 will be described further below.

An alternate embodiment of electrochemical process in unipolar filter press electrolyser assembly 16 may be sodium chlorate electrolysis, where the starting electrolyte is comprised of sodium chloride in water, referred to as "brine." The anode product is gaseous chlorine, and the cathode products are hydrogen gas and sodium hydroxide.

A further alternate embodiment of electrochemical process in unipolar filter press electrolyser assembly 16 may be the chlor alkali process, where the anode product is gaseous chorine and the cathode products are hydrogen gas and sodium hydroxide.

The chlor alkali process and the sodium chlorate production process are well known to those skilled in the art of electrolysis, as their chemical products, chlorine, hydrogen, sodium hypochlorite and sodium hydroxide (also known as caustic soda) are sold into a wide array of chemical industries to create well known products such as bleach (made from chlorine), hydrochloric acid, and hydrogen peroxide (made from hydrogen).

It will occur to those skilled in the art that other electrochemical processes may occur in unipolar filter press electrolyser assembly 16 or electrochemical devices, where products are created for different uses within industry.

In the embodiments described herein, the principles of the present inventions are implemented in unipolar filter press electrolyser assemblies, however, it will be appreciated that in alternative embodiments the principles of the invention could also be successfully implemented in other electrochemical assemblies, for instance, in monopolar electrolyser assemblies or bipolar electrolyser assemblies.

FIG. 1A illustrates a schematic lateral cross-sectional view of the electroactive regions of a basic unipolar current carrying configuration shown generally by the half-cell 2 with electroactive structures attached. The unipolar current carrying configuration comprises an electrical current carrying structure 6 that provides multiple electroactive structures 7 of the same polarity on opposing sides of the current carrying structure 6, such that regions of the same universal polarity 3 are provided on the opposing sides of the current carrying structure 6, and such that current is provided by a power source 5 and flows across in the direction of arrow 4 in the current carrier 6 and to electroactive structures 7. Typically, the current flows in a parallel direction to the electroactive structures 7 from left to right. The half-cell in FIG. 1A creates the base current carrying unit for a unipolar electrochemical filter press device constructed of positive and negative half-cell pairs.

Figure 1B:
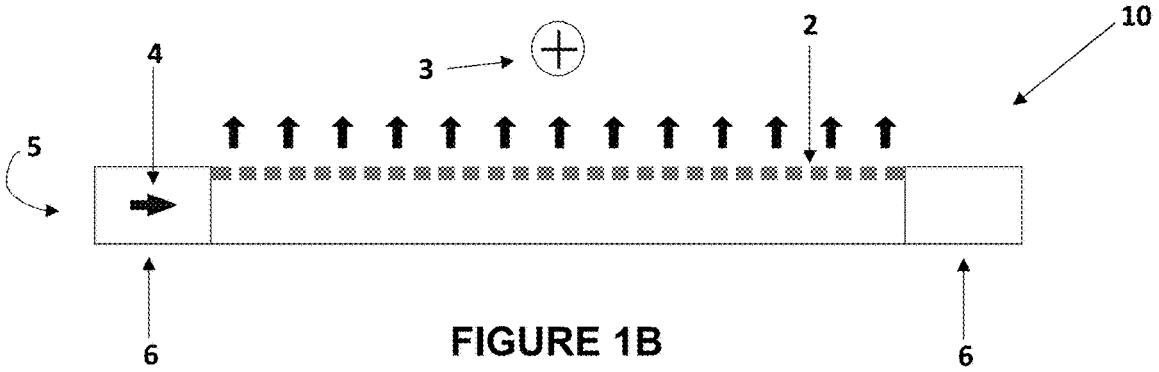
FIG. 1B shows a schematic lateral cross-sectional view of a base current carrying half-cell unit of a monopolar electrolyser filter press, comprising one electroactive structure of a single polarity on one side of the current carrier configured electrically in parallel.

FIG. 1B illustrates a schematic lateral cross-sectional view of the electroactive region of a basic monopolar current carrying configuration shown generally by the half-cell 10 with an electroactive structure attached. The monopolar current carrying configuration comprises an electrical current carrying structure 6 that provides an electroactive structure 7 of a singular polarity on one side of the current carrying structure 6, such that a region of one polarity 3 is provided on the side of the current carrying structure 6 that possesses the electroactive structure 7, and such that current is provided by a power source 5 and flows across in the direction of arrow 4 in the current carrier 6 and to the electroactive structure 7. Typically, the current flows in a parallel direction to the electroactive structure 7 from left to right. The half-cell in FIG. 1A creates the base current carrying unit for a monopolar electrochemical filter press device constructed of positive and negative half-cell pairs.

Figure 1C:
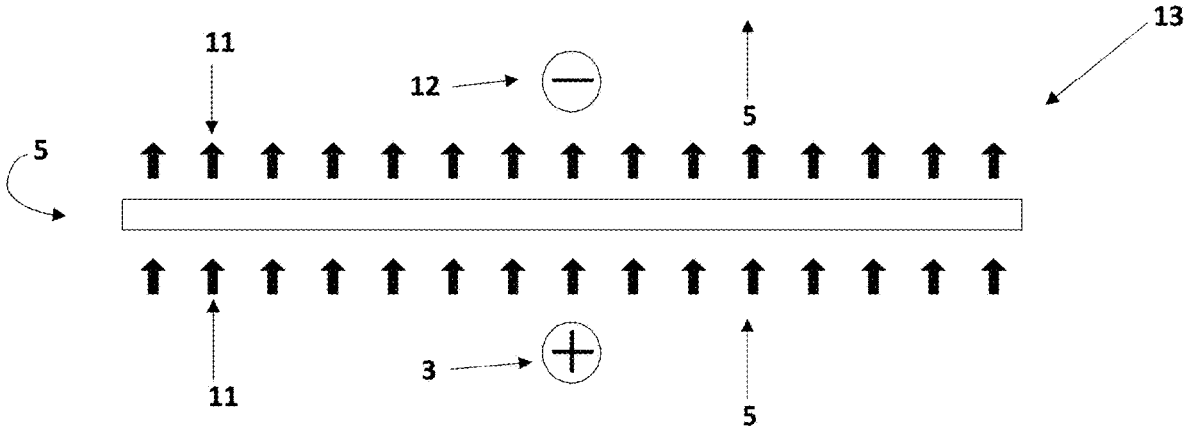
FIG. 1C shows a schematic lateral cross-sectional view of a base current carrying unit of a bipolar electrochemical filter press device, comprising a bipolar wall defining electroactive areas of opposite polarity configured electrically in series.

FIG. 1C illustrates a schematic lateral cross-sectional view of the electroactive regions of a basic bipolar current carrying configuration, shown generally by a bipolar wall 8 defining electroactive areas of opposite polarity on opposing sides of the current carrying structure, such that regions of opposite polarity (3, 12) are provided on the opposing sides of the bipolar wall 8, and such that current is provided by a power source 5 and flows through the bipolar wall orthogonally 11, creating the base current carrying unit for a bipolar electrochemical filter press device. Cells within a bipolar filter press are electrically connected in series, with each individual current carrier typically comprising one anodic side and one cathodic side connected by the conductive bipolar wall. The bipolar wall 8 is a non-porous electrically conductive wall with electrodes separating the anodic and cathodic halves. Naturally, this cannot be porous, as that would allow oxygen and hydrogen to mix which is dangerous in the case of water electrolysis.

Returning to FIG. 2, each unipolar filter press electrolyser assembly 16 includes a filter press frame components arranged to form a filter press stack, also referred to herein as a stacked array of CCFs 9, and a pair of end assemblies 160 mounted on each end of the stacked array of CCFs 9. Stacked array of CCFs 9 may be part of a single electrochemical cell, which may be expanded longitudinally by adding additional CCFs to the stacked array of CCFs 9. The stacked array of CCFs 9 creates a unipolar filter press stack and may be defined as an electrochemical cell with electrode plates (CCFs) configured electrically in parallel. In alternative embodiments, but not shown, bipolar plates or monopolar electrodes may be used to create a filter press stack. In the embodiments below, unipolar filter press electrolyser assemblies 16 are described.

End assembly 160 has three beneficial functions for monopolar and unipolar filter press electrolyser assembly 16 that apply to all embodiments described within: gas/liquid separation, downwards electrolyte recirculation and clamping of the filter press/stacked array of CCFs 9. Each of these functions will be further described below.

Each end assembly 160 prevents the mixing of conductive electrolyte fluids between each unipolar filter press electrolyser assembly 16 with end assemblies 160 connected to each end of unipolar filter press electrolyser assembly 16, but sealed and separated between multiple unipolar filter press electrolyser assemblies 16.

End assemblies 160 create an electrolyte recirculation system which allows for electrolyte departing the filter press/stacked array of CCFs 9 to be recirculated after the product gases are removed. Electrolyte recirculation, combined with makeup reactant, sustains reactant within the system at all times. This sustains the required level of reactant and electrolyte in the system for continued reactions.

With regards to the clamping of the filter press/stacked array of CCFs 9, end assembly 160 achieves this using two elements: end plate component 50A and end clamp 82A. As previously mentioned the end clamp 82A compresses the stacked array of CCFs 9 by applying a clamping force on end plate component 50A to prevent the flow of fluid exchanging to the external atmosphere and to securely retain the filter press stack. End plate component 50A compresses the stacked array of CCFs 9 and prevents the mixing of anolyte, catholyte, oxygen and hydrogen within the internal channels as defined by apertures 54 and 70. In addition, end plate component 50A forms a fluid management chamber between itself and end clamp 82A.

Several embodiments of end assemblies 160 are presented herein. In the embodiments presented herein, end assemblies 160 are optimized for and are intended for use within a unipolar filter press electrolyser assemblies 16 with alkaline water electrolysis processes. However, it will occur to the person skilled in the art that such end assemblies 160 are not limited to alkaline water electrolysis processes and may be applicable to other electrolysis processes and also other electrochemical devices.

FIG. 5A showcases an exploded view of an embodiment of end assembly 160 and a representative CCF 80 (also referred to herein as a filter press frame component). Filter press frame component 80 corresponds to the last frame component from the stacked array of CCFs 9. End assembly 160 includes an end plate component 50A, an end clamp 82A, and several non-limiting gaskets 98 and 106, and masking components 102 and 118.

Masking components 102, 118, and gaskets 98, 106 provide electrical and chemical isolation to end assembly 160, effectively electrically and physically insulating end clamp 82A from end plate component 50A and from stacked array of CCFs 9.

In the current embodiment, gasket 106 is positioned between end plate component 50A and filter press frame component 80. Gasket 106 also has two apertures that align with the channels formed filter press frame component 80 and stacked array of CCFs 9. Gasket 98 is positioned between end plate component 50A and end clamp 82A and is aligned to the flange of end clamp 82A. Gasket 98 also and provides a seal for isolating the internal pressure within the filter press stack from external atmospheric pressure. Gasket 98 is a rectangular frame surrounding a rectangular opening, where the rectangular opening surrounds hollow space 51.

In the current embodiment, masking components 102, 118 and gasket 106 are separate components, however it is contemplated that masking components 102 and 118 may be integrated into gasket 106 as a single moulded piece.

End plate component 50A has edges 45, 46, 47 and 48, creating a rectangular plate. In the current embodiment, edges 45 and 46 represent the width of end plate component 50A, and edges 47 and 48 represent the length of end plate component 50A. It will occur to the person skilled in the art that end plate component 50A may be any shape, and may not include edges 45, 46, 47 and 48 (such as a circular plate), however it is preferred that the dimensions of end plate component 50A essentially match or substantially correspond to those of the individual CCFs in the stacked array of CCFs 9.

End plate component 50A may include mechanical support components 62, 58, 74, and 78, apertures 54 and 70. Mechanical support components 58, 74, 62 and 78 may have perforated holes 66 formed within to allow liquid and gas to flow and circulate downward into the bottom of the unipolar filter press electrolyser assembly 16.

Figure 4A:
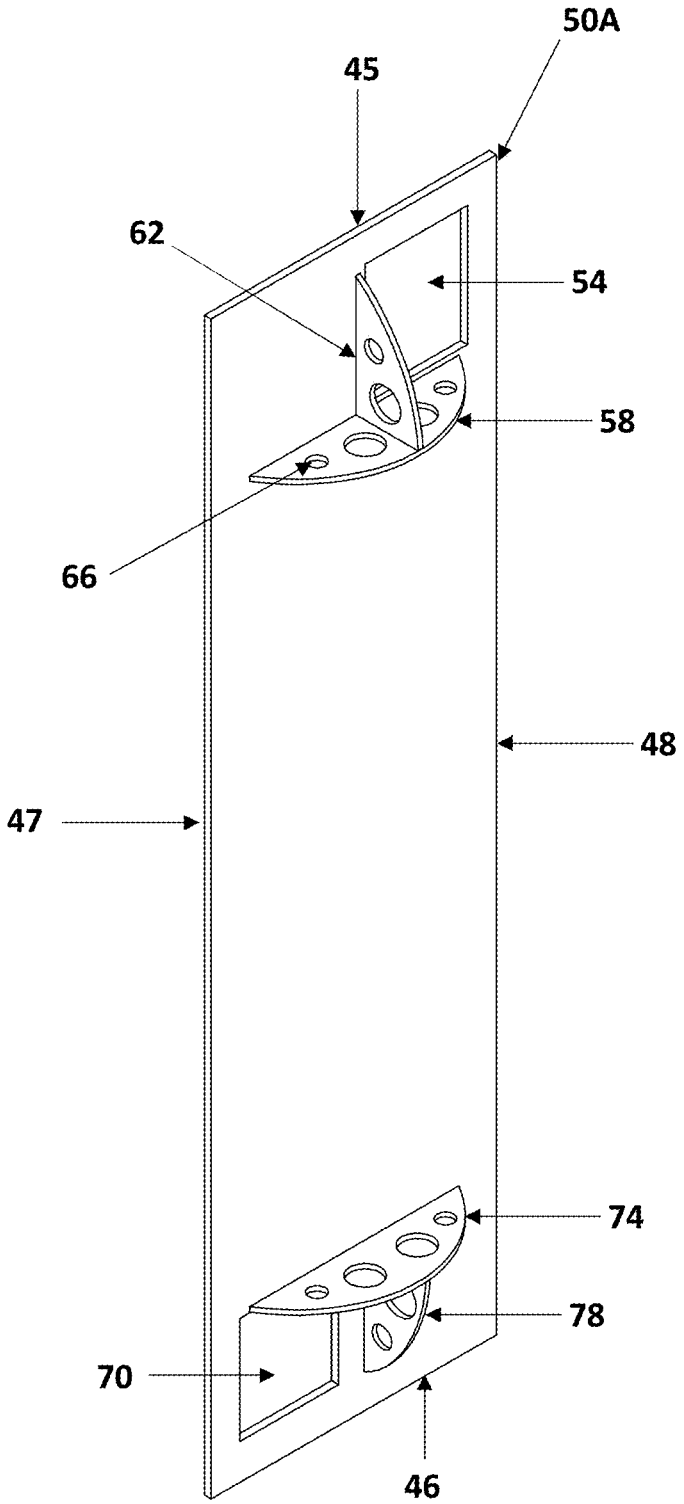
FIG. 4A shows front perspective view of an end plate component according to an embodiment of the invention for use in a unipolar filter press electrolyser end assembly comprising upper and lower mechanical support members.

Referring to FIG. 4A, which depicts an embodiment of end plate component 50A, apertures 54 and 70 are present. Apertures 54 and 70 are for gas and liquid to flow from the stacked array of CCFs into end assembly 160 where liquid electrolyte may be recirculated into the stacked array of CCFs, and product gas may be vented out. In the current embodiment, apertures 54 and 70 are generally square, defined by a pair of opposed left and right vertical inner edges and opposed upper and lower horizontal inner edges. It may be contemplated that apertures 54 and 70 are not limited to being generally square, but may be of any shape. Apertures 54 and 70 are aligned with other apertures and channels formed within the stacked array of CCFs 9 to allow a gas and liquid to flow through. In the current embodiment, aperture 54 is aligned with the upper channel formed within stacked array of CCFs 9, where aperture 54 is to receive a stream of liquid electrolyte and gas from the filter press stack. Aperture 70 is aligned with the lower channel formed within stacked array of CCFs 9, where aperture 70 is to receive a stream of recirculated liquid electrolyte to send back into the filter press stack.

In the current embodiment, apertures 54 and 70 are located on opposing corners of end plate component 50A, being disposed diagonally relative to each other. More specifically, aperture 54 is partially defined by members along edges 45 and 48 and is disposed adjacent to the upper end of end plate component 50A, while aperture 70 is partially defined by members along edges 46 and 47 and is disposed adjected the lower end of end plate component 50A. In other embodiments, aperture 54 may be partially defined by members along edges 45 and 47, while aperture 70 is partially defined by members along edges 46 and 48. Alternatively, apertures 54 and 70 may not be diagonally opposed. Aperture 54 may be defined partially by members along edges 45 and 48, while aperture 70 may be defined partially by members along edges 46 and 48. In alternate embodiments, aperture 54 may be partially defined by members along edges 45 and 47, while aperture 70 may be defined partially by members along edges 46 and 47. It will occur to a person skilled in the art that there are different combinations and arrangements for apertures 54 and 70 on end plate component 50A. In addition, it will occur to a person skilled in the art that apertures 54 and 70 are not limited to being the same size and shape as depicted in FIG. 4A, and may be of different sizes and shapes. It will also occur to a person skilled in the art that end plate component 50A is not limited to apertures 54 and 70, and may include other apertures. Embodiments that are not limited to apertures 54 and 70 will be discussed below.

Mechanical support components 58, 74, 62 and 78, as depicted in FIG. 4A, may be compatible with a variety of accessories which may be applied to the end assemblies according to the present disclosure. For example, mechanical support components 58, 74, 62 and 78 must be compatible with the insertion of different types of tubes, as the water addition liquid level in the cell may fall below the area of the truss. Consequently, the designer may choose to insert tubes through holes in the members for water addition, cooling, purging, level sensing or an alternative accessory. Non-limiting tubing for non-limiting functions may be directed externally from outside the filter press through the end clamping plate through the end assembly through the inner end plate and into the filter press with or without the option of return the tubing to any location in or out of the end assembly. Some examples of such tubing includes delivery of the use of air cooling coils, reactant addition such as water, and product removal such as hydrogen and oxygen. The purge gas such as argon and other inert gases, as well as non-flammable gases such as nitrogen, and in the case of purging oxygen from normally oxygen containing locations in the filter press, the use of air. The use of oxygen for purging the parts of the filter press which normally have oxygen present is particularly helpful when the filter press is in operation at low current density, such as would be found, using solar panels, wind turbines, or an electrical grid which is modulating down to partial current loads. In these cases, the current might be reduced to only 1% or less of the nominal current at the fore load and by adding air it may dilute any hydrogen travelling from the normally hydrogen producing containing locations through the separator into the normally oxygen containing locations. Nitrogen in the air will dilute any modest increase in the presence of hydrogen. The accessories and instrumentation which may be applied to a filter press end assembly, is non-limiting. Accessories may additionally enter the end assembly through the top plate of the filter press and/or the external clamping element.

In the current embodiment, mechanical support components 58 and 74 have a semi-circular profile (also referred to herein as semi-circular reinforcement flanges) and are attached and protrude outwards from the flat surface (or face) of end plate component 50A, where the plane of mechanical support components 58 and 74 is parallel to edges 45 and 46 of end plate component 50A (also referred to herein as the horizontal flange portion). Mechanical support components 62 and 78 have a quarter-circular profile (also referred to herein as quarter-circular reinforcement flanges) and are attached and protrude outwards from the flat surface of end plate component 50A, where the plane of mechanical support components 58 and 74 is parallel to edges 47 and 48 (also referred to herein as the vertical flange portion). In a preferred embodiment, each pair of horizontal flange portion and vertical flange portion of mechanical support components are fixed by way of welding, press fitting, or mechanical fastening to each other to form a generally T-shaped structure, and make up a mechanical support member. Alternatively, horizontal flange portions and vertical flange portions may be in close proximity to each other forming the generally T-shaped structure. The vertical flange portions extend towards the edge of end plate component 50A and may run adjacent to one of the vertical inner edges of the apertures, while parts of the horizonal flange portions may run adjacent to the one of the horizontal inner edges of the apertures. In the current embodiment, mechanical support components 58 and 62 make up a mechanical support member positioned near the upper end of end plate component 50A to reinforce the area around aperture 54. The vertical flange portion, mechanical support component 62, extends from the horizontal flange portion, mechanical support component 58, towards edge 45, the top end of end plate component 50A. The vertical flange portion, mechanical support component 62, also runs adjacent to one of the vertical inner edges of aperture 54. A part of horizonal flange portion, mechanical support component 58, runs adjacent to the lower horizontal inner edge of aperture 54. Similarly, mechanical support components 74 and 78 make up a mechanical support member positioned near the lower end of end plate 50A to reinforce the area around aperture 70. The vertical flange portion, mechanical support component 78, extends from the horizontal flange portion, mechanical support component 74, towards edge 46, the bottom end of end plate component 50A. The vertical flange portion, mechanical support component 78, also runs adjacent to one of the vertical inner edges of aperture 70. A part of horizontal flange portion, mechanical support component 74, runs adjacent to the upper horizontal inner edge of aperture 70.

As previously indicated, perforated holes 66 allow for tubing to be inserted for the flow of gasses and liquids as well as the flow of gasses and liquids not in tubing. The shape of mechanical support components 58, 74, 62 and 78 are not limited to a semi circular shaped or a quarter-circular shape. Furthermore, mechanical support components 58, 74, 62 and 78 are not limited to flanges. FIG. 8A, 8B, 8C, 8D and 8E shows five varying mechanical support members for use with end plate component 50A.

Figure 8A:
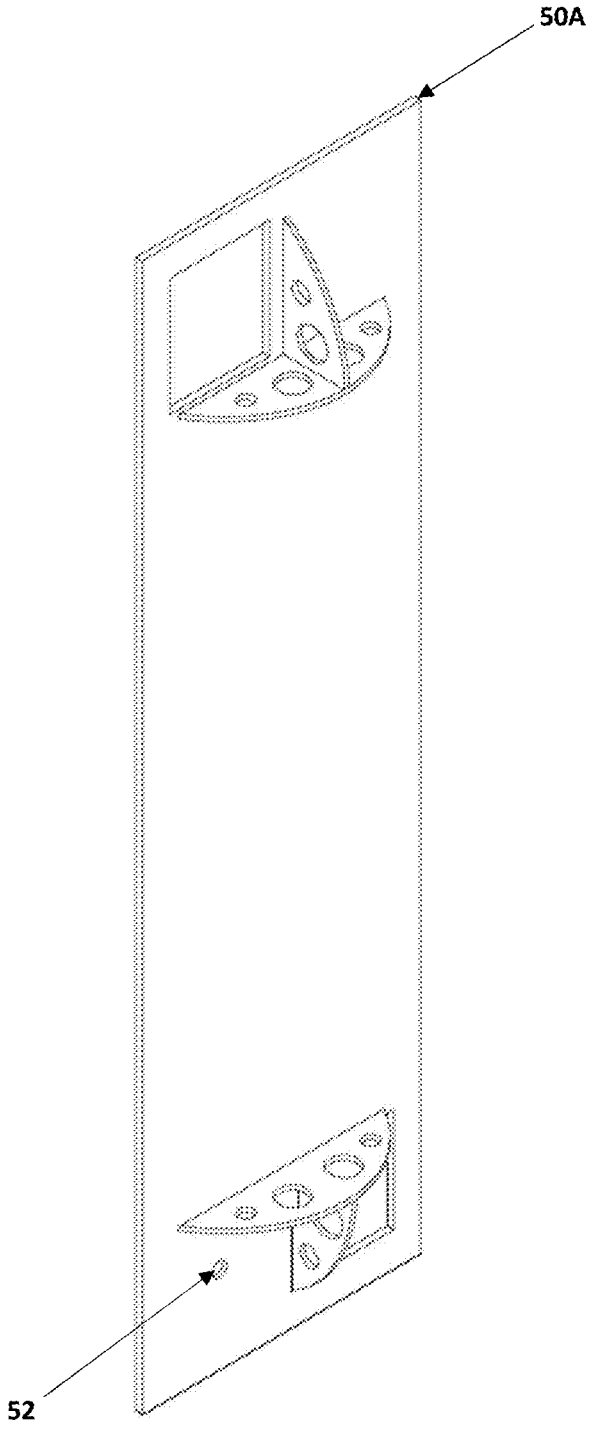
FIG. 8A shows a front perspective view of an end plate component according to a first alternative embodiment of the invention.
Figure 8B:
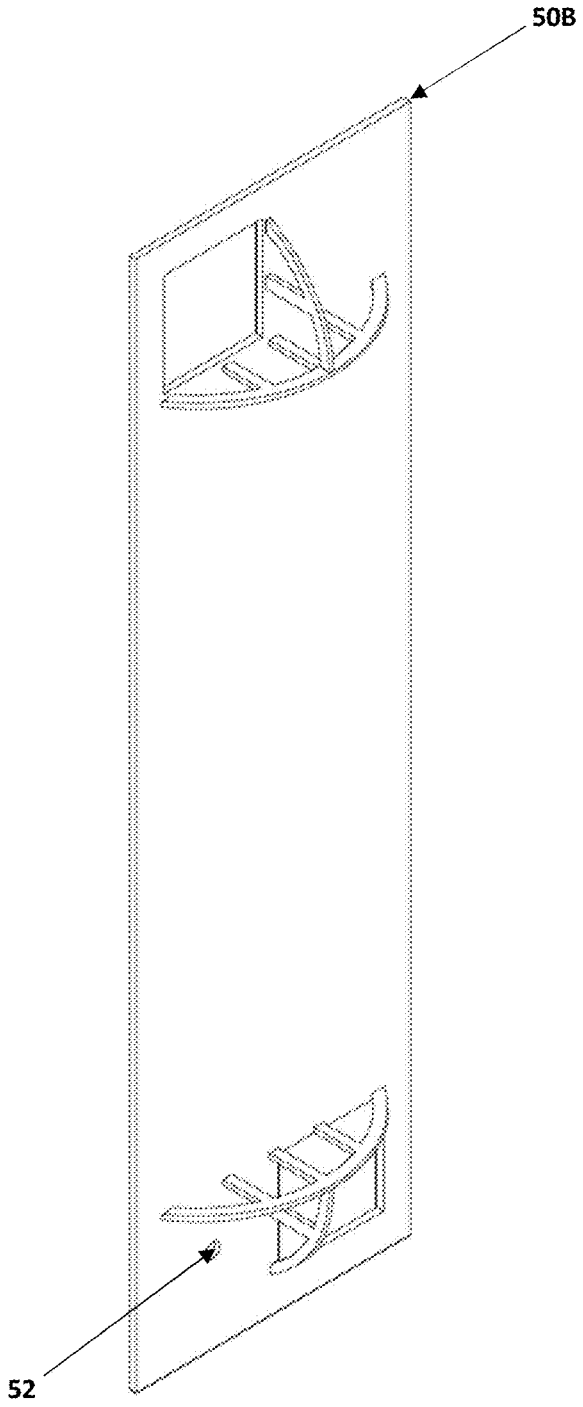
FIG. 8B shows a front perspective view of an end plate component according to a second alternative embodiment of the invention.

FIG. 8B depicts an alternate embodiment with end plate component 50B, where a circular frame is used for mechanical support components 58, 74, 62 and 78. Perforated holes 66 are larger through-holes defined by members between end plate component 50A and the circular frame for mechanical support components 58, 74, 62 and 78. The larger through-holes allow for tubing to be inserted for the flow of gasses and liquids. Mechanical support components 58, 74, 62 and 78 also applies pressure to prevent cross-contamination of gasses to improve gas purity.

Figure 8C:
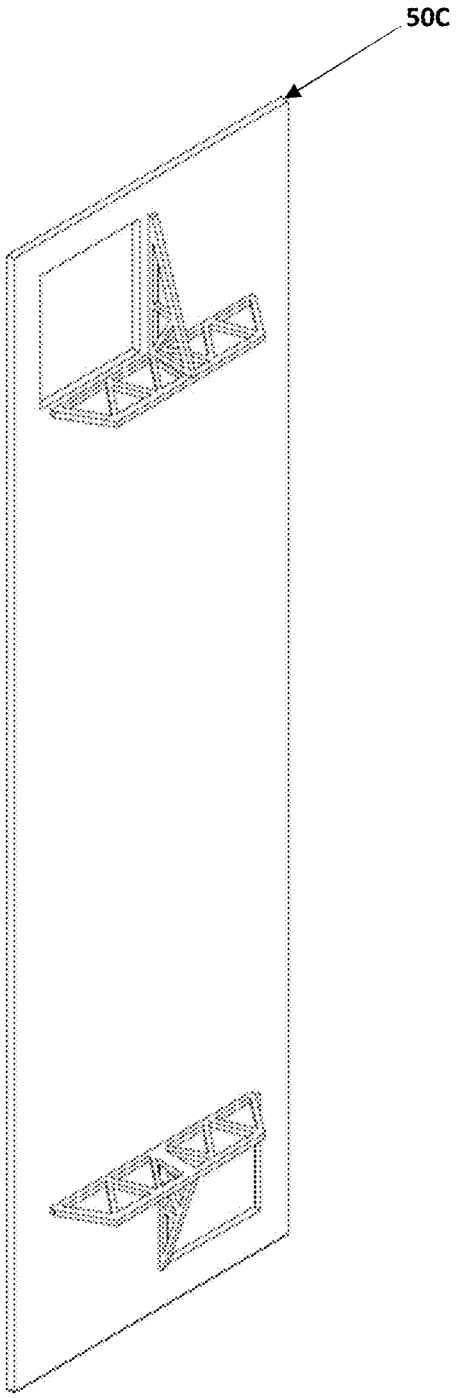
FIG. 8C shows a front perspective view of an end plate component according to a third alternative embodiment of the invention.

FIG. 8C depicts another alternate embodiment with end plate component 50C, where mechanical support components 58, 74, 62 and 78 are made up of members arranged in a truss configuration. More specifically, where a vertical truss portion and a horizontal truss portion, such as mechanical support components 58 and 62, are fixed to each other to form a generally T-shaped structure. Horizontal truss portions and vertical truss portions may be in a trapezoidal truss configuration, or may be in a triangular truss configuration. In the current embodiment, horizontal truss portions, mechanical support components 58 and 74, are made up of members in a trapezoidal truss configuration. Vertical truss portions, mechanical support components 62 and 78 are made up of members in a triangular truss configuration. It will occur to a person skilled in the art that mechanical support components 58, 74, 62 and 78 may all be in trapezoidal truss configuration, or may all be in triangular truss configuration, or may be a mixture of both truss configurations. It will also occur to a person skilled in the art that truss configurations may not be limited to trapezoidal or triangular shaped. Perforated holes 66 are larger triangular through-holes defined by members between end plate component 50A and mechanical support components 58, 74, 62 and 78.

Figure 8D:
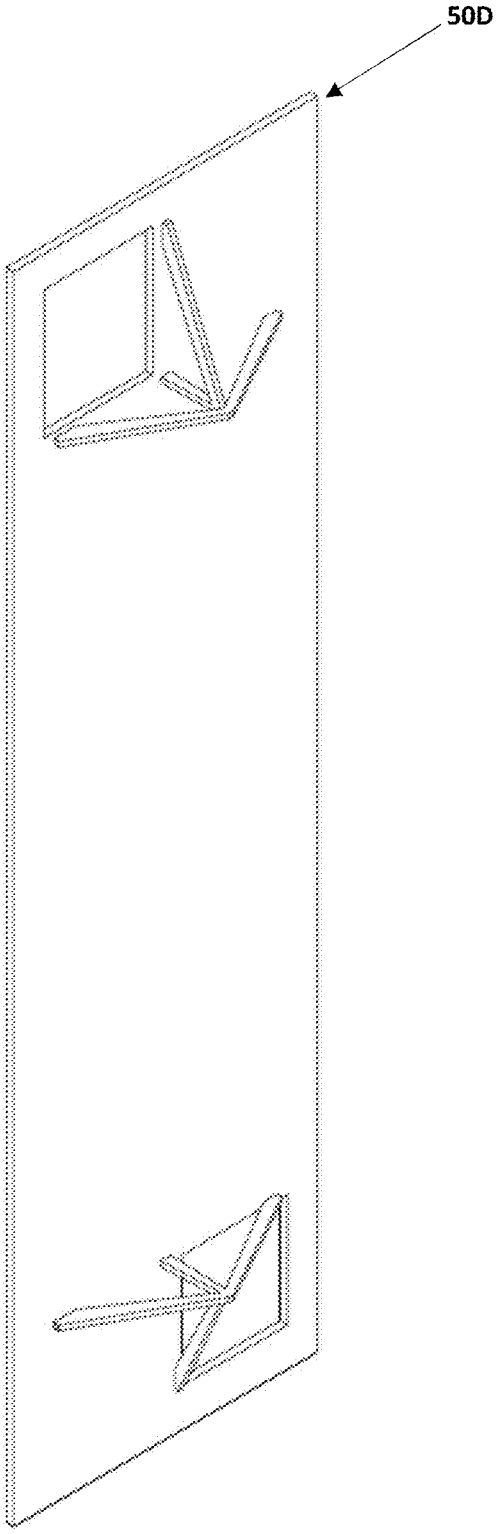
FIG. 8D shows a front perspective view of an end plate component according to a fourth alternative embodiment of the invention.

FIG. 8D depicts a further embodiment with end plate component 50D, where mechanical support components 58, 74, 62, and 78 are made up of members in a triangular frame. Perforated holes 66 is the area between the mechanical support components 58, 74, 62 and 78 that are members and the surface of end plate component 50A. A member may be present along a normal vector from the flat surface of end plate component 50D to mechanical support components 58 and 74, splitting the area between the mechanical support components 58 and 74 and the surface of end plate component 50D into two smaller triangular through-holes.

In a preferred embodiment, mechanical support components 58, 74, 62 and 78 are positioned adjacent to the inner edges of apertures 54 and 70, as indicated above. This allows for additional mechanical support and compression along the borders of apertures 54 and 70, and also to the channels defined by apertures 54 and 70 in the filter press stack. It will occur to a person skilled in the art that mechanical support components 58, 74, 62, and 78 may be placed in different arrangements and in different locations on end plate components 50A, 50B, 50C, and 50D. It will also occur to a person skilled in the art that additional mechanical support components or additional mechanical support members may be placed on end plate components 50A, 50B, 50C, and 50D. In addition, it will occur to a person skilled in the art that fewer mechanical support components or fewer mechanical support members, such as a single mechanical support member, may be attached to the surface of end plate component 50A, 50B, 50C, and 50D.

Figure 8E:
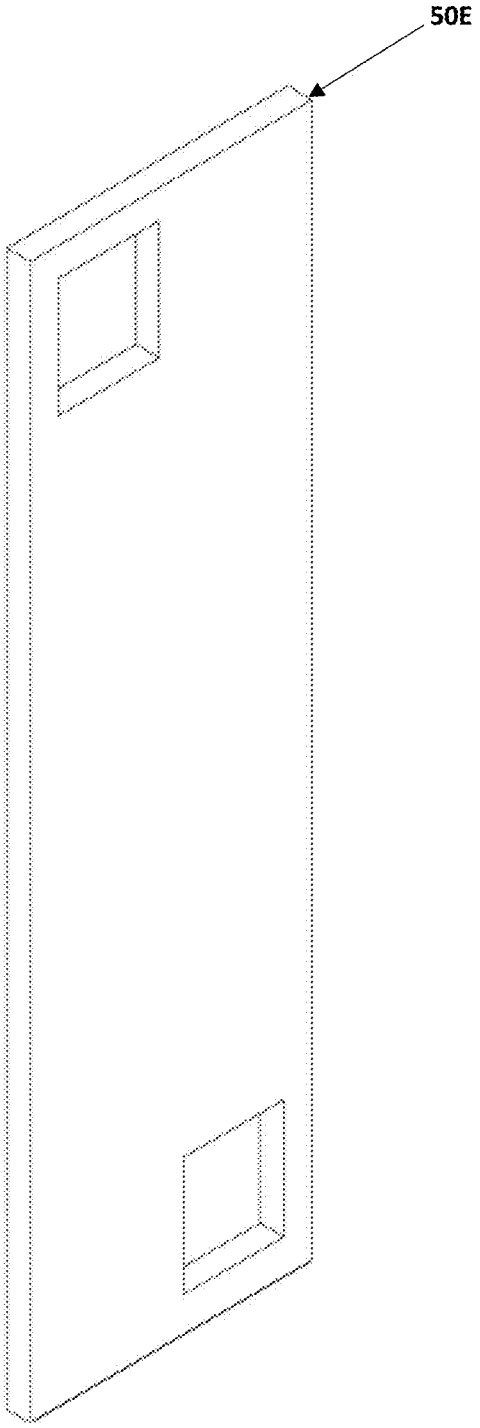
FIG. 8E shows a front perspective view of an end plate component according to a fifth alternative embodiment of the invention.

Mechanical support components 58, 74, 62 and 78 are optional, as there may not be a need to provide additional reinforced support. FIG. 8E depicts still another embodiment with end plate component 50E, where mechanical support components 58, 74, 62 and 78 are not present. Rather end plate component 50E lacks mechanical support components 58, 74, 62 and 78, and is a flat surface. It is further contemplated (not shown), that there are embodiments of end plate component 50A, where mechanical support components 58 and 74 are present, but mechanical support components 62 and 78 are not present, or where mechanical support components 62 and 78 are present, but mechanical support components 58 and 74 are not present.

It will occur to a person skilled in the art that there are different arrangements and different variations in the shapes of mechanical support components 58, 74, 62 and 78 included on end plate component 50A, and different variations on having (or the lack of having) perforated holes 66 to support tubing. Furthermore, it will occur to a person skilled in the art that there are different combinations as to whether mechanical support components 58, 74, 62 and 78 are present on end plate component 50A.

In addition, in some embodiments, aperture 52 may also be included on end plate component 50A as depicted in FIG. 8A and FIG. 8B. Aperture 52 may be included to provide a channel to facilitate the mixing of the anolyte and catholyte. Aperture 52 creates an additional pathway for electrolyte to flow from the electrolyte return chamber into an electrolytic distribution channel within the stacked array of CCFs. Preferably, aperture 52 would be located at the bottom of end plate component 50A, which contains less of the electrolytic product gases which would preferably not allow the mixing of anolyte and catholyte. While not shown in FIG. 8, additional apertures may be placed on end plate component 50A which has catholyte flowing through the electrolyte return chamber, end plate component 50A which has anolyte flowing through the electrolyte return chamber, or both. Non-limiting gasket and masking pieces may further be used to seal the fluids from the external environment. The size of aperture 52 or additional apertures may be selected based on the regulation of the fluid in a manner similar to an orifice and are non-limiting in dimension. It is contemplated that there are various configurations, arrangements and sizes of aperture 52 and additional apertures on end plate component 50A. It is also contemplated that aperture 52 may be located on different embodiments of end plate component 50A, including, but not limited to, to end plate component 50B, end plate component 50C, end plate component 50D and end plate component 50E.

As mentioned above, in alternate embodiments, end plate component 50A may not be limited to only apertures 54 and 70, and may further include other apertures. For example, FIG. 7D shows a fluid management system whereby, for example, the catholyte and hydrogen gas entering end assembly 168 from the stacked array of CCFs 9. However, the return of the electrolyte flowing through the electrolyte return chamber is not returned to the catholyte distribution header within the stacked array of CCFs 9. Instead, the aperture for the catholyte distribution header at the bottom of the CCF is blocked. An aperture 71 is created allowing the catholyte to enter the anolyte distribution header at the bottom of the CCF. This fluid circulation pathway allows for constant recirculation of the anolyte and catholyte so that the electrolyte is well mixed and the concentration of the anolyte and the catholyte are nominally the same. A similar arrangement using anolyte and oxygen gas entering the opposing end assembly 160 of the stacked array of CCFs could also be implemented whereby the anolyte flowing through the electrolyte return chamber passes through an aperture 71 which connects with the catholyte distribution header at the bottom of the stacked array of CCFs.

FIG. 7E shows a fluid management system whereby, for example, the catholyte and hydrogen gas entering end assembly 168 from the stacked array of CCFs 9 separate into end assembly 160 through aperture 110. However, the return of the catholyte flowing through the electrolyte return chamber is directed to both the catholyte and anolyte distribution headers through apertures 70 and 71. A similar arrangement using anolyte and oxygen gas entering the opposing end assembly 160 of the stacked array of CCFs 9 could also be implemented whereby the anolyte flowing through the electrolyte return chamber passes through both apertures 70 and 71 entering both the catholyte and anolyte distribution headers. In this embodiment, apertures 70 and 71 are disposed side-by-side adjacent to the lower end of end plate component 50A.

End plate component 50A, as depicted in FIG. 4 and FIG. 8A, may be fabricated of a unitary metallic piece, with corrosion resistant materials including, but not limited to steel, nickel, low carbon steel, stainless steel, titanium or Hastelloy® (nickel-molybdenum alloy). End plate component 50A may also be coated in nickel plating for corrosion resistance. The embodiment of end plate component 50B as depicted in FIG. 8B is particularly appropriate for nickel plating as mechanical support components 58, 74, 62 and 78 have a minimal surface area for attachment to end plate component 50B, allowing more of end plate component 50B to be knuckle coated, while still maintaining the necessary structural support and space for downward electrolyte recirculation. There are multiple non-limiting methods to manufacture end plate component 50A, including, but not limited to, stamped, roll-formed, machined, cast, laser cut and plasma cut. End plate component 50A may also be covered by a masking material which may be any one or combination of, but not limited to: fluoropolymers, elastomers, thermoplastics (specifically Santoprene™), ethylene propylene diene monomer (EDPM) rubber, Teflon™, polypropylene, polyethylene or Viton™ rubber.

As the pressure on either side of end plate component 50A is nominally the same, the required rigidity of end plate component 50A is less than would be required if end plate component 50A were exposed to external pressure outside of the unipolar filter press electrolyser assembly 16. For further clarification, referring to FIG. 7B, the mechanical support members applying internal force 166 do not have to be subjected to the higher forces required to seal external forces 162 and 158. This allows for a reduction of the required mechanical strength of end plate component 50A, and hence end plate 50A may be a lower thickness. End plate component 50A may have a thickness of approximately 3/16 inches to 2 inches. In the current embodiment, end plate component 50A may have a preferred thickness of approximately 3/8 inches to 1/2 inch. The benefits of the lower required mechanical strength of end plate component 50A is reduced weight and reduced cost. Rigidity of end plate component 50A is important, as it aids in sealing the internal chambers of unipolar filter press electrolyser assembly 16. In the current embodiment, the rigidity of end plate component 50A aids in sealing the oxygen and hydrogen internal chambers, and prevents mixing between the two channels. In addition, unlike in a bipolar arrangement where full support across the entire end area of the filter press stack is required, a unipolar arrangement requires less support across the end area of the filter press stack and can be limited to support around the outer edges of end plate component 50A, and the inner edges of apertures 54 and 70.

In addition, end plate component 50A forms one of the required walls to create a downward circulation chamber. This allows for integration of electrolyte management features between the downwards circulation chamber and unipolar filter press electrolyser assembly 16 components. It also allows for the end assembly 160 to be made of two separate parts.

Other methods to increase convection could also include the addition of devices to increase air circulation to one or more end assemblies 160 which form an array of unipolar filter press electrolyser assemblies 16. Enhanced circulation of convective cases can be applied to one end or both ends of an array of unipolar filter press electrolyser assemblies 16. Other methods of head heat removal may include the application of coatings that increase the emissivity of any end assembly 160 surface.

Returning to FIG. 5A, end assembly 160 further includes end clamp 82A. End clamp 82A compresses the stacked array of CCFs 9 to prevent the flow of fluid exchanging to the external atmosphere.

In the current embodiment, the body of end clamp 82A (also referred to herein as the shell of end clamp 82A) has a substantially rectangular profile when viewed from the top, where the hollow space 51 within the rectangular profile body accommodates mechanical support components 58, 74, 62 and 78 to reside. Hollow space 51 is also configured to redirect a stream of liquid electrolyte substantially free of gases toward aperture 70 for recirculation in the filter press stack. Hollow space 51 is part of the management of the liquid electrolyte and gas and will be further explained below.

The body of end clamp 82A is not limited to a substantially rectangular profile when viewed from the top, and may have a semi-circular profile when viewed from the top, as depicted by end clamp 144A in FIG. 7A. Furthermore, while not show, it is contemplated that the body of end clamp 144A may have an ellipsoidal head on the top, the bottom, or both the top and the bottom of the body of end clamp 144A. An ellipsoidal head may allow for a greater pressure difference between inside hollow space 51 and the exterior of unipolar filter press electrolyser 16. Other shapes are contemplated for end clamp 82A, and will be further discussed below.

It will also occur to a person skilled in the art that hollow space 51 may be shaped based on the body of end clamp 82A. For example, end clamp 82A has a substantially rectangular profile when viewed from the top, and correspondingly hollow space 51 of end clamp 82A also has a substantially rectangular profile when viewed from the top. Similarly, end clamp 144A has a semi-circular profile when viewed from the top, and correspondingly hollow space 51 of end clamp 144A also has a semi-circular profile when viewed from the top. While it is preferred that the profile of the body of an end clamp matches that with hollow space 51 to conserve materials, other embodiments may include hollow space 51 that does not correspond to the profile or shape of the body. A hollow space 51 may be a different profile or shape as long as it fits within the body. Furthermore, while hollow space 51 has a constant cross section in the body of end clamp 82A and end clamp 144A, in other embodiments, the hollow may have a variable cross section. For example, hollow space 51 may taper towards the bottom of an end clamp.

Returning to FIG. 5A, end clamp 82A also includes a flange surrounding the body of end clamp 82A for facilitating the connection of end clamp 82A to the filter press stack and for applying pressure against the filter press stack to create a seal. In the current embodiment, the thickness of the flange is greater than the thickness of the body of end clamp 82A to support structural rigidity. This also allows the body of end clamp 82A to be thinner minimizing material usage and saving cost. The thickness of the flange can range from ⅜ inches to 2 inches. In a preferred embodiment, the thickness of the flange ranges from ¼ inches to 1 inches. The thickness of the body or shell of an end clamp may range from ⅛ inches to ⅜ inches. In the current embodiment, assuming an internal pressure between 0 psig to 100 psig, the thickness of the body of end clamp 82A has a preferred thickness of 3/16 inches. If the internal pressure is greater than 100 psig, reinforcing gussets 138 or alternative means of strengthening support such as external rings may be used. Furthermore, the thickness of the flange may be further minimized through the use of strengthening members along the perimeter of the flange. As an example, if the flange is fabricated from a polymer material, the flange may be thin or lack the support needed to apply pressure against the filter press stack. Reinforcement members in the nature of C-shaped channel members or L-shaped channel members may be attached to the perimeter of the flange to provide additional support. In a preferred embodiment, the body of end clamp 82A is a single unitary piece with the flange. Similarly, in embodiments where the body is of a different profile, such as in end clamp 144A, a single unitary piece with the flange is preferred. However, it will occur to a person skilled in the art that the body may be fabricated separately from end clamp 82A and 144A, and may then be attached together by for example, welding.

End clamp 82A further includes gas offtake port 90 and accessory port 94. Gas offtake port 90 is designed to extract gases from the stream of liquid electrolyte and gases flowing from aperture 54 and discharge the extracted/product gas out of unipolar filter press electrolyser assembly 16. For example, oxygen gas or hydrogen gas may be vented from gas offtake port 90. Gas is vented out of gas offtake port 90 in direction 122. Gas offtake port 90 may be located in various positions on the outer surface of end clamp 82A, where the position of gas offtake port 90 affecting direction 122 in which gas is vented. In the current embodiment, gas offtake port 90 is disposed adjacent to the upper end of end clamp 82A and extends outwardly from and substantially perpendicular to the outer surface of end clamp 82A. In alternate embodiments, gas offtake port 90 may extend from the top portion of end clamp 82A.

Accessory port 94 allows any one or a combination of analytic and control accessories to be attached to end assembly 160. External instrumentation or accessories may also be attached via accessory port 94, allowing the addition of reactants, make up of electrolyte, purging of gases, draining of the end assembly of liquid electrolyte, control of levels, temperatures, pressures, or flows. Analytic accessories may include cooling coils, argon/nitrogen purge cases, and heat exchangers.

In the current embodiment where the body of end clamp 82A is a substantially rectangular profile when viewed from the top with a hollow space 51, gas offtake port 90 and accessory port 94 are positioned on surface 91 adjacent to the upper end of end clamp 82A, where direction 122 is in a direction that is normal to surface 91.

In alternate embodiments, end clamp 82A may have more than one gas offtake port to support the volume of gas being vented. Alternatively, to support an additional volume of gas being vented, a single gas offtake port 90 with a larger diameter may be used.

In alternate embodiments, end clamp 82A may include a secondary accessory port 96 for additional external instrumentation or analytic accessories to be attached. In the current embodiment, secondary accessory port 96 is positioned on surface 92 adjacent to the lower end of end clamp 82A.

It will occur to a person skilled in the art that end clamp 82A may include different combinations, arrangements, and the optional inclusion of gas offtake port 90, first accessory port 94, and second accessory port 96. Furthermore, it will also occur to a person skilled in the art that the position of gas offtake port 90, first accessory port 94 and second accessory port 96 are not limited, and may be placed anywhere on end clamp 82A, as long as the gas offtake port 90, first accessory port 94 and second accessory port 96 have access to the gases and liquids inside unipolar filter press electrolyser assembly 16. It will also occur to a person skilled in the art that any number of additional accessory ports may be included on end clamp 82A and may be located at various locations on end assembly 160 depending on the desired operation, measurement function or control purpose of the accessory being attached to accessory ports 94, 96 or any additional accessory ports.

Figure 5B:
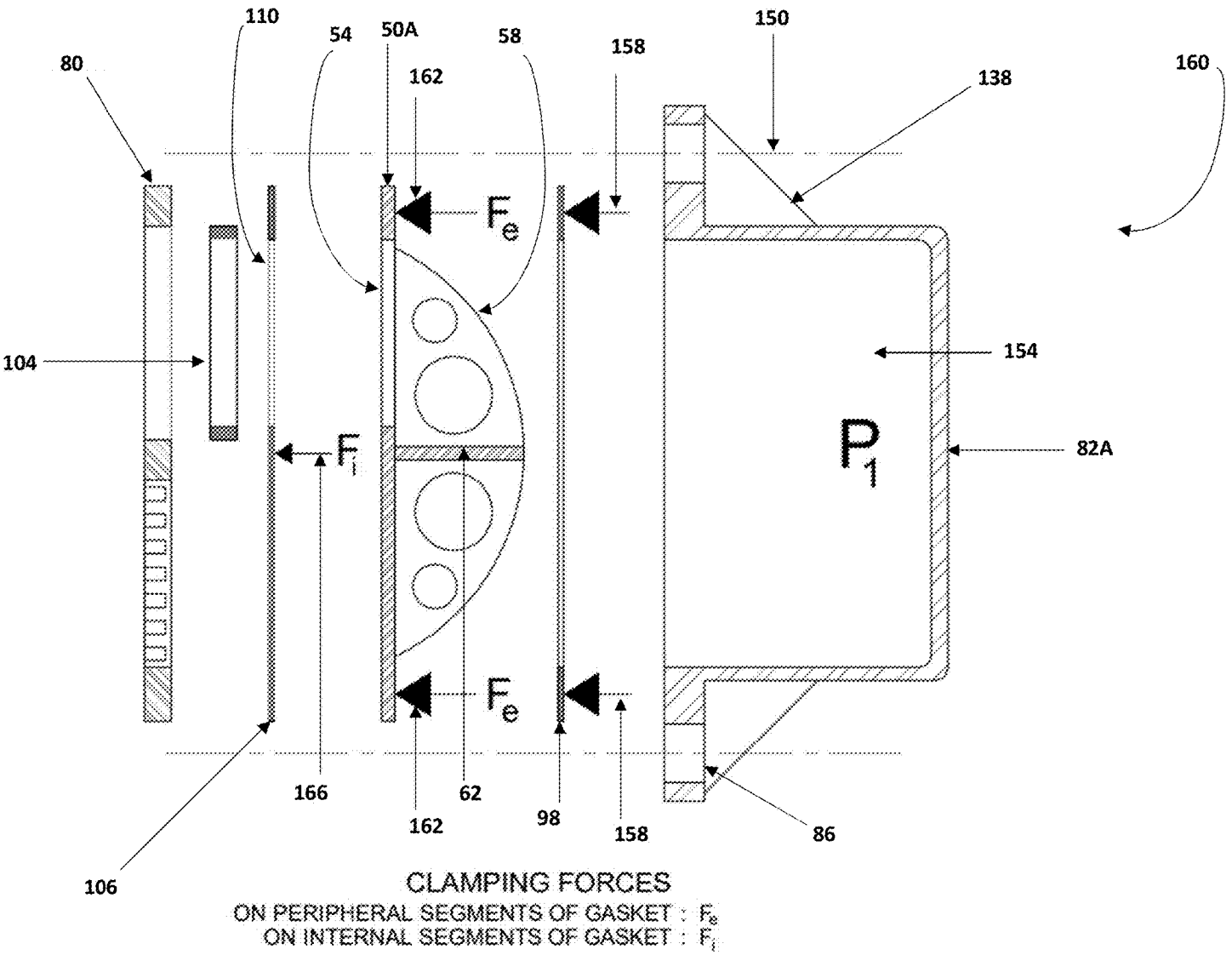
FIG. 5B shows a cross-sectional view of the end assembly depicted in FIG. 5A taking along line "5B-5B" with arrows included to indicate the directionality of external and internal forces applied on the end assembly when assembled and clamped as a filter press.
Figure 5C:
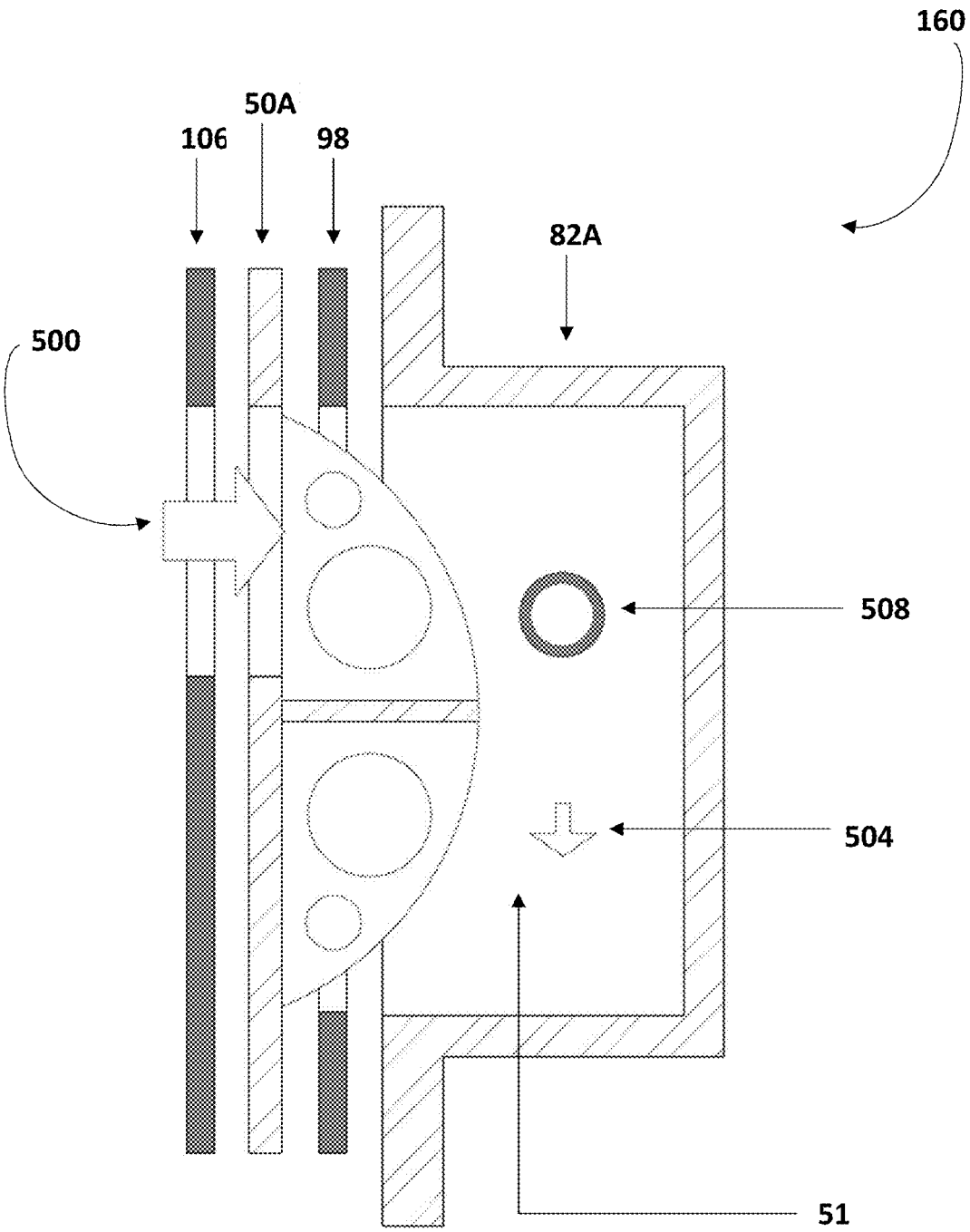
FIG. 5C shows another cross-sectional view of the end assembly similar to that shown in FIG. 5A except that the end assembly is shown assembled with arrows indicating the flow of gases and fluids.

FIG. 5C shows another exploded cross-sectional view of the disassembled end assembly 160. The direction of gas/electrolyte mixture 500 is shown going through aperture 54 of end plate component 50A. The electrolyte return 504 is shown in space 51, and the direction of the gas vent 122 from gas offtake port 90 is shown. In this embodiment, gas offtake port 90 is placed on a different surface of 82A, however, it is also possible to be placed vertically at position 508, similar to the gas offtake port 90 depicted in FIG. 5A.

Figure 9A:
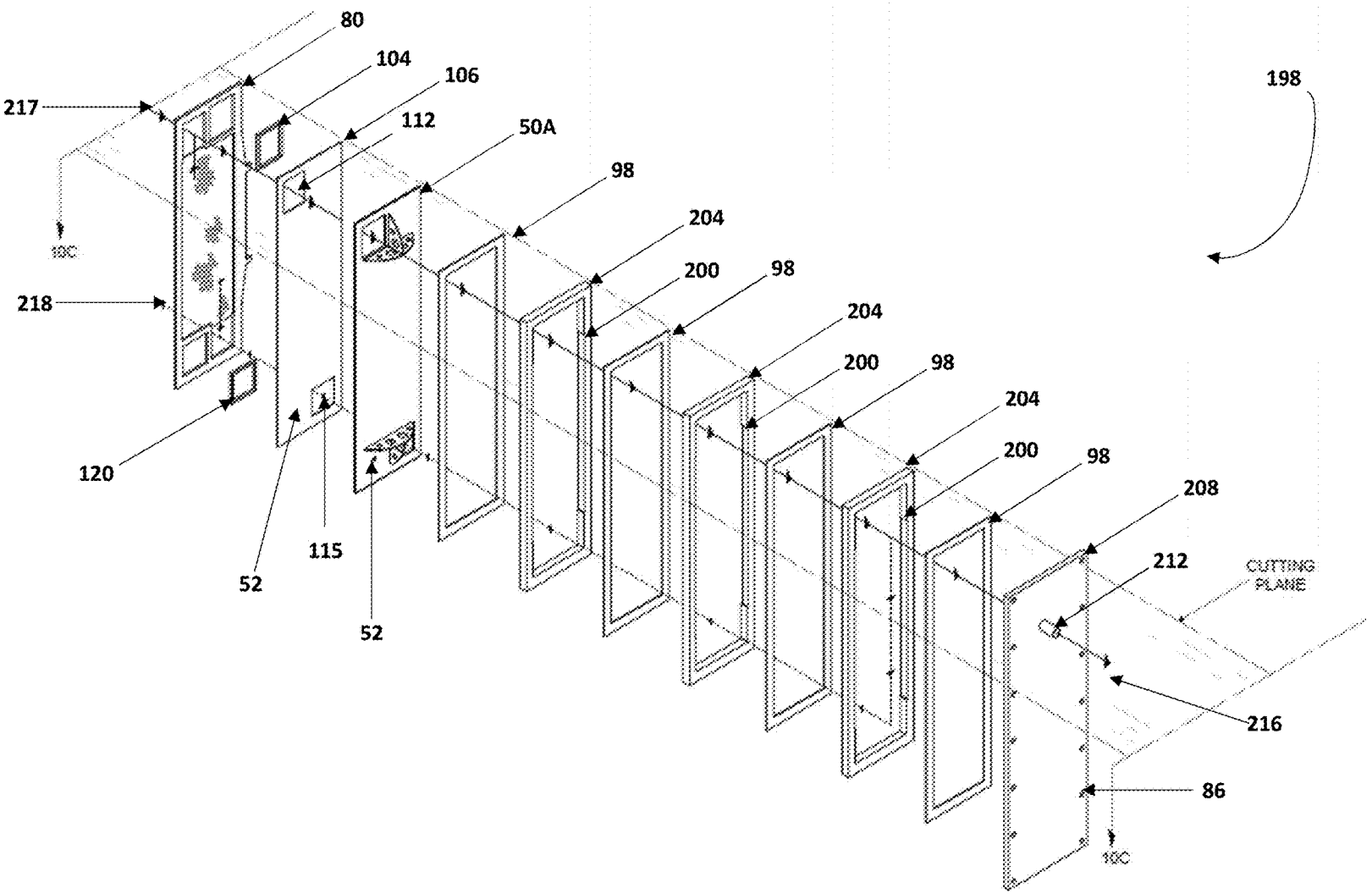
FIG. 9A shows an exploded front perspective of one end of a unipolar filter press electrolyser for alkaline water electrolysis according to an embodiment of the invention depicting a filter press frame component, an inner end plate component according to FIG. 4A, several modular rigid hollow frame components (also referred to herein as rigid hollow frame components) to create longitudinal space in the filter press, a substantially flat end clamping component, and several gasket and masking components for sealing purposes.

The stream of liquid electrolyte and gas 123 is depicted in FIG. 5A. Stream of liquid electrolyte and gas 123 flows through the channel defined by the filter press stack and aperture 54. Stream of liquid electrolyte and gas 123 collects additional liquid electrolyte and gas at each CCF within the stacked array of CCFs 9. The stream of liquid electrolyte and gas 123 travels through the channel and discharges into the hollow space 51 (shown in FIG. 5C). The hollow space only partially fills with the liquid electrolyte leaving a void above the liquid electrolyte. The gas being lighter than the liquid electrolytes rises through the liquid into the void to thereafter exits through gas offtake port 90. As will be appreciated by a person skilled in the art, care must be taken to ensure that the level of liquid electrolyte in hollow space 51 is at a level to allow a sufficient void to be formed for the gas to rise and bubble from the liquid electrolyte and gas mixture, and for the separation of the liquid electrolyte and gas. The denser liquid electrolyte 130 then flows downwards within hollow space 51, where it is recirculated through aperture 70. In alternate embodiments, separation of the liquid electrolyte and the gas may also occur within the channel, and upon discharge into hollow space 51, the void receives the gas, and the liquid electrolyte flows downwards within hollow space 51. A similar process is depicted in FIG. 9A, where stream of liquid electrolyte and gas 216 travels through the channel, and at hollow space 51 created by hollow rigid frame components 204, the stream of liquid electrolyte and gas 216 is separated into gas 216 and liquid electrolyte 218. Gas 216 is dispersed through gas offtake port 212, and the denser liquid electrolyte 218 is diverted by hollow space 51 into aperture 70 to be recirculated.

Referring to FIG. 2, as previously mentioned, end assemblies 160 are located on either end of the filter press stack, where one end assembly separates oxygen 14A from the anolyte and a second end assembly 160 that separates hydrogen 15A from the catholyte. When the unipolar filter press electrolyser 16 is in operation, the stream of electrolyte and gases received from the filter press stack and in aperture 54 of the first end assembly 160 may be a stream of oxygen and an anolyte. The anolyte is separated from the oxygen in hollow space 51, and the anolyte is received by aperture 70 of the first end assembly as a stream of recirculated liquid anolyte. Similarly, the stream of electrolyte and gases received from the filter press stack in aperture 54 of the second end assembly 160 may be a stream of hydrogen and a catholyte. The catholyte is separated from the hydrogen in hollow space 51, and the catholyte is received by aperture 70 of the second end assembly as a stream of recirculated liquid catholyte.

As previously mentioned, the body of end clamp 82A is not limited to a substantially rectangular profile when viewed from the top. In FIG. 7A, the body of embodiment end clamp 144A has a semi-circular profile when viewed from the top, where gas offtake port 90 and accessory port 94 is on surface 91, and second accessory port 96 is on surface 92.

Referring to FIG. 7C, in another embodiment, the body of end clamp 144B has a semi-circular profile when viewed from the top and includes lateral cross struts 146 spanning the hollow between the flange of the end clamp for further mechanical rigidity.

Figure 7F:
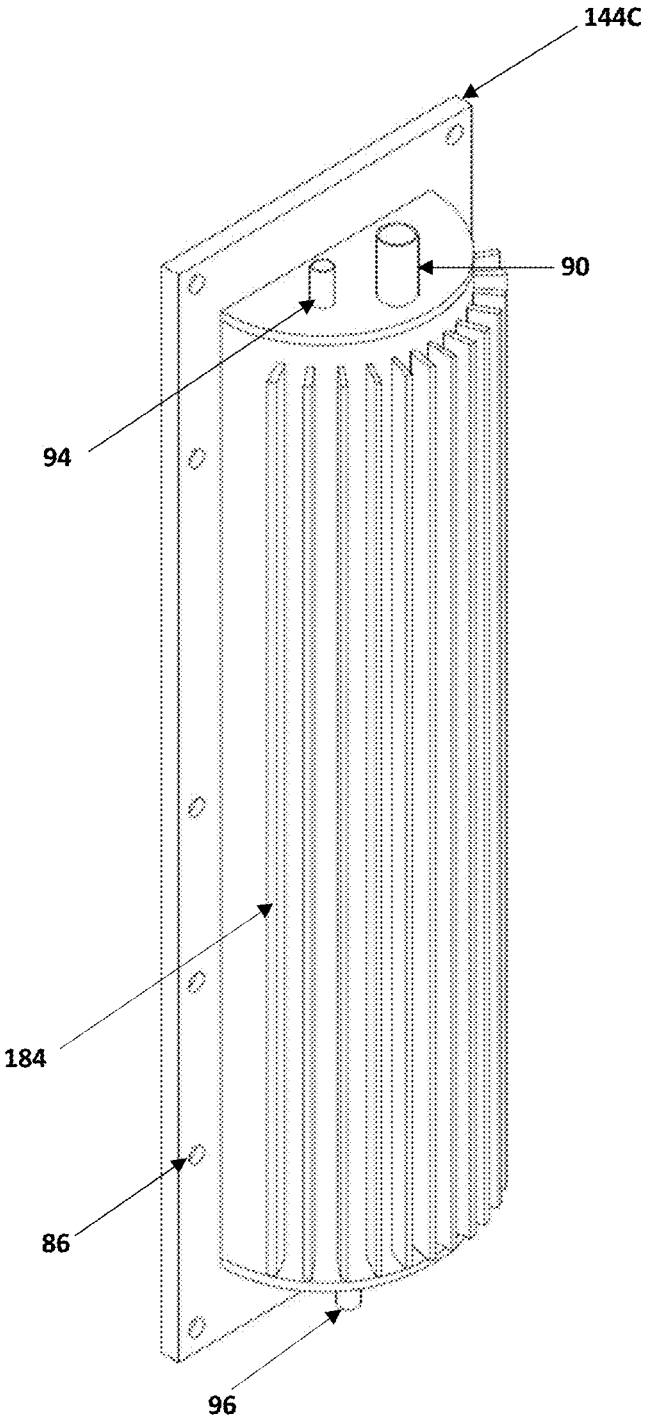
FIG. 7F shows a front perspective view of an end clamp embodiment according the present disclosure for use in a unipolar filter press electrolyser wherein vertical fins (also referred to herein as cooling fins) are provided on the exterior of the end clamp to increase surface area for heat transfer from the air external to the filter press allowing for an air cooled assembly, where the end clamp has a semi-circular profile.
Figure 7G:
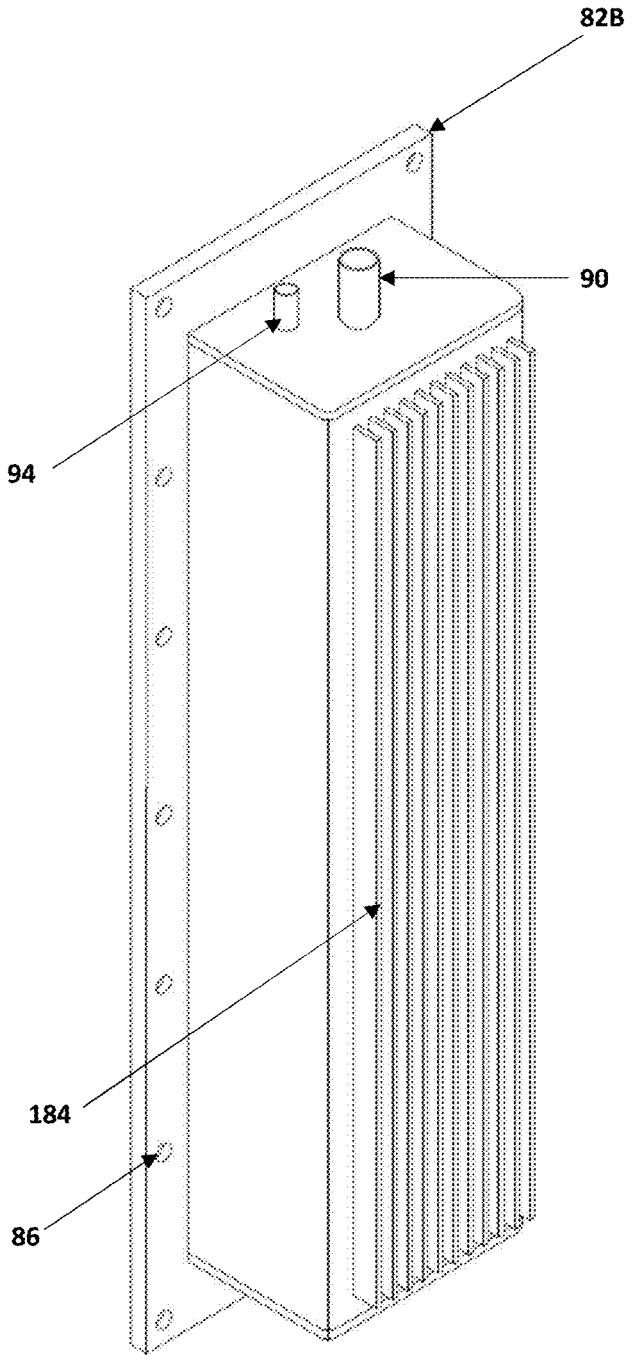
FIG. 7G shows a front perspective view of an alternate end clamp embodiment according to the present disclosure for use in a unipolar filter press electrolyser wherein vertical fins are provided on the exterior of the end clamp to increase surface area for heat transfer from the air external to the filter press allowing for an air cooled assembly, where the end clamp has a substantially rectangular profile.
Figure 7H:
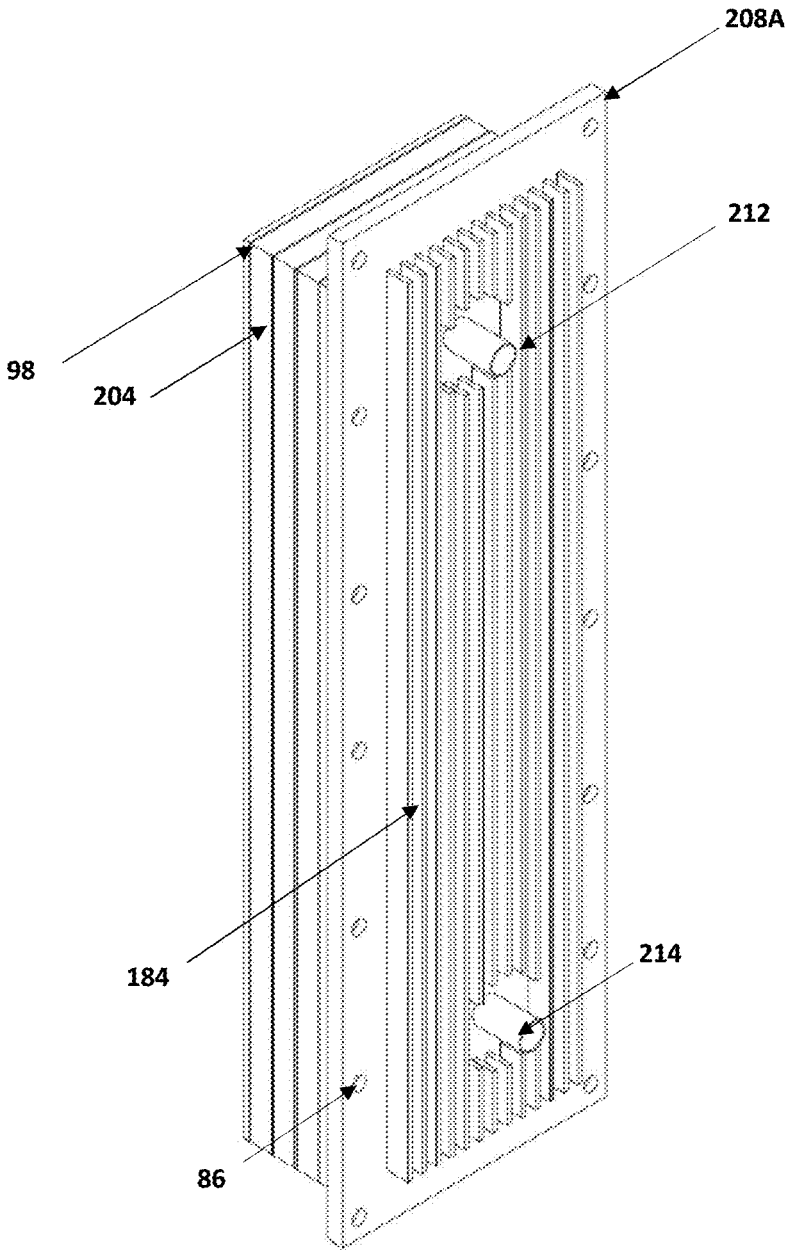
FIG. 7H shows a front perspective view of another alternate end clamp embodiment according to the present disclosure for use in a unipolar filter press electrolyser wherein vertical fins are provided on the exterior of the end clamp to increase surface area for heat transfer from the air external to the filter press allowing for an air cooled assembly, where the end clamp is a substantially flat end clamping component.
Figure 7I:
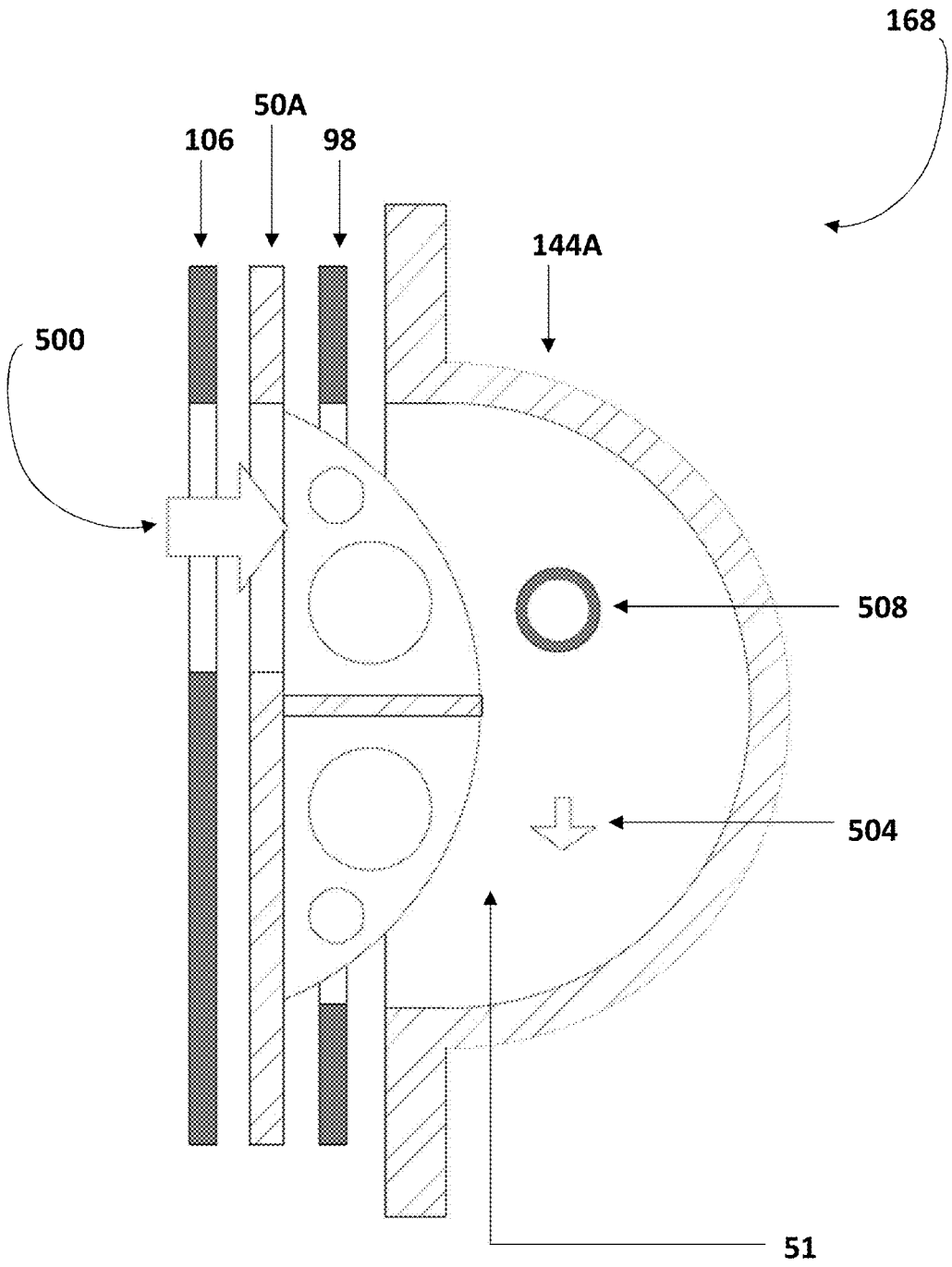
FIG. 7I shows a cross-sectional view similar to the one illustrated in FIG. 7A except that in this view the end assembly is shown assembled and arrows are provided to indicate the flow of gases and fluids.

FIG. 7I shows another cross-sectional view of the dissembled end assembly 160 with end clamp 144A. The direction of gas/electrolyte mixture 500 is shown going through aperture 54 of end plate component 50A. The electrolyte return 504 is shown in space 51, and the direction of gas 122 from gas offtake port 90 is shown. In this embodiment, gas offtake port 90 is placed on a different surface of 144A, however it is also possible to be placed vertically at position 508, similar to the gas offtake port 90 depicted in FIG. 7A.

Figure 9B:
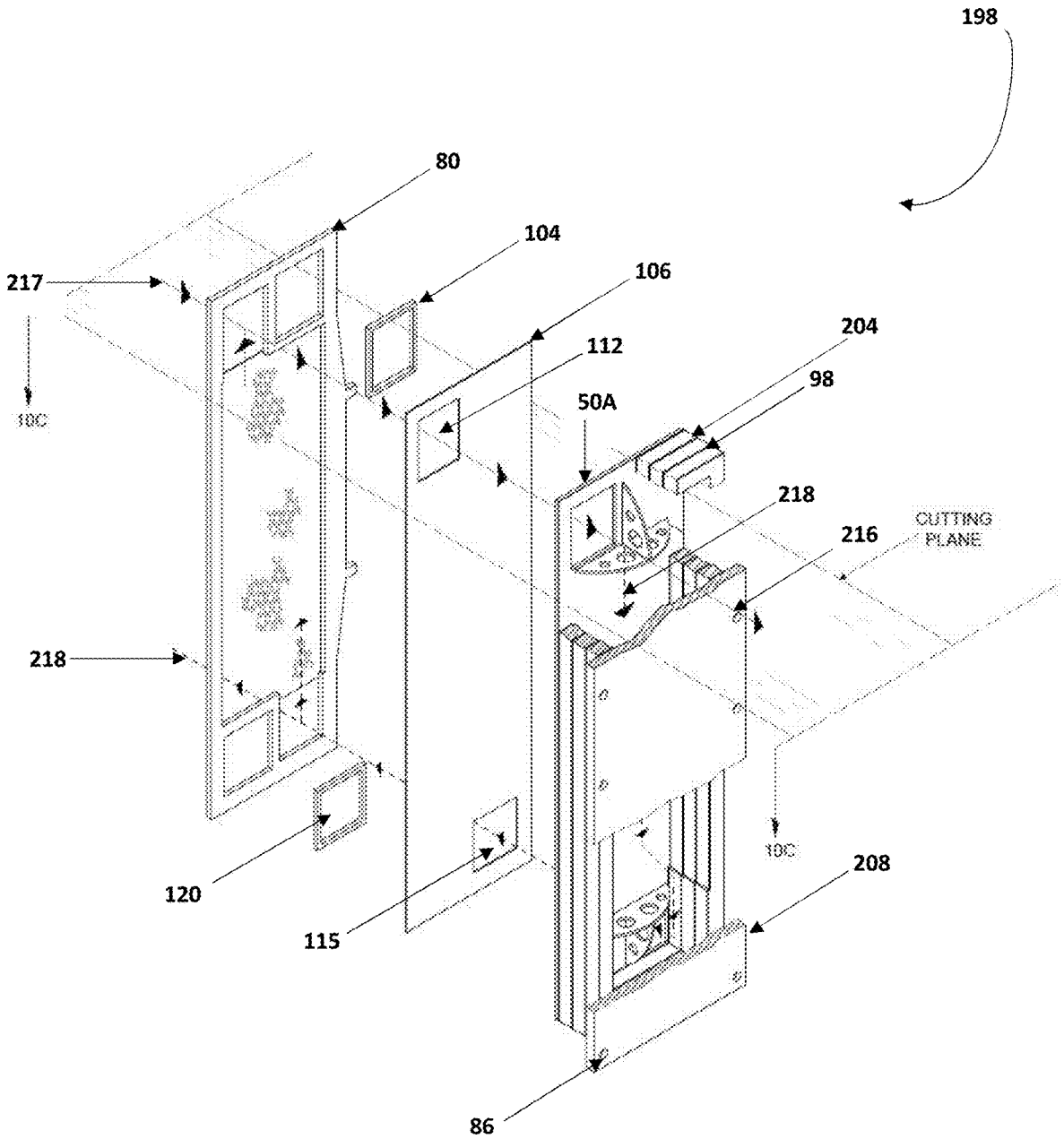
FIG. 9B shows a partially exploded front perspective view of one end of the unipolar filter press electrolyser for alkaline water electrolysis illustrated in FIG. 9A wherein an end plate component according to FIG. 4A, several modular rigid hollow frame components, a substantially flat end clamping component and several gasket and masking components for sealing purposes are shown, and where portions of the substantially flat end clamping component are omitted to reveal details of the interior, and where the partially exploded front perspective view is exploded from the filter press frame component and the gasket and masking components, the view being further provided with arrows to represent the recirculation of electrolyte from the product transfer passageway, falling down through the upper aperture of the end plate component, and recirculation back into the filter press through the lower aperture of the end plate component.

Referring to FIG. 9A, in another embodiment, end assembly 198 includes end clamp 208 which is a plate that is substantially flat, with gas offtake port 212, and accessory port 224 on the flat surface of end clamp 208, where gas is vented normal to the flat surface of end clamp 208 in direction 216. In this embodiment, a hollow space behind the flat surface of end clamp 208 is created through several modular rigid hollow frame components 204 and intermediate gaskets 98 (also referred to as intermediate gasket members) placed together to create a longitudinal space, to accommodate mechanical support members attached to end plate component 50A. The intermediate gaskets 98 are positioned between adjacent rigid frame components 204 to create a seal. A final gasket member 98 is between the end clamp 208 and rigid frame component 204. Rigid frame components 204 may also include, but not limited to, plasma or laser cut lateral rungs in opposing frames for further support with downward fluid flow. An example of lateral rungs will be further discussed below. FIG. 9B depicts an embodiment wherein an end clamp 208 is assembled with modular rigid hollow frame components 204 and gaskets 98. Stream of liquid electrolyte and gas 217 is shown flowing through product transfer passageway (also referred to herein as channel), through aperture 112 of end plate component 50A. Gas 220 is separated and exits unipolar filter press electrolyser 16 through gas offtake port 212. Denser liquid electrolyte 218 is recirculated back into stacked array of CCFs 9 through aperture 115. One benefit of this embodiment is the reduction in the amount of welding required, resulting in other fabrication mechanisms which can be employed more readily and further simplifying manufacturing on end clamp 208.

Figure 9C:
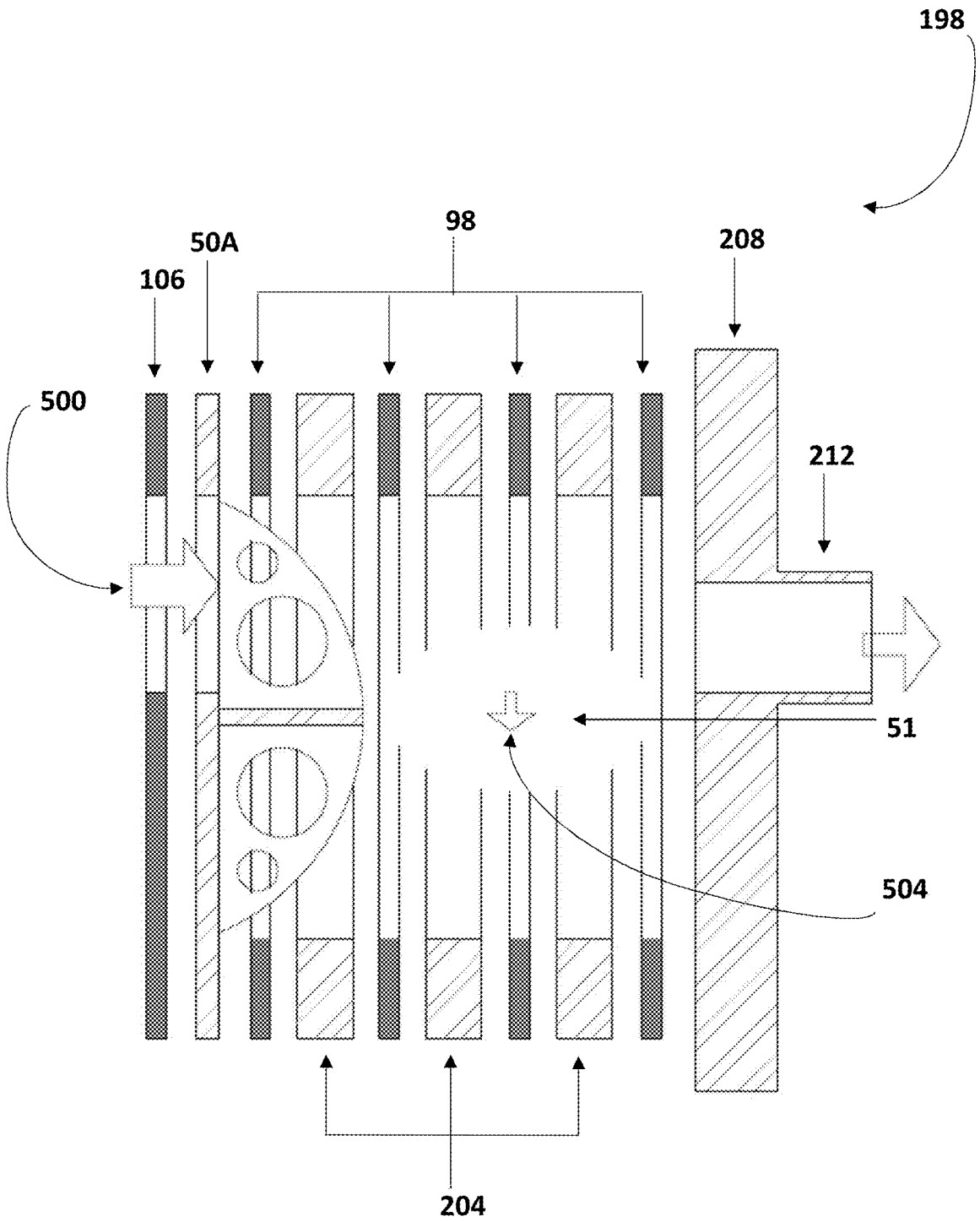
FIG. 9C shows a cross-sectional view of the end assembly depicted in FIG. 9B taken along line "9C-9C", but with various components shown assembled (except for the filter press frame component which has been omitted) and arrows included to indicate the flow of gases and fluids.

FIG. 9C shows a top-down cross-sectional view of the disassembled end assembly 198. The direction of gas/electrolyte mixture 500 is shown going through aperture 54 of end plate component 50A. The electrolyte return 504 is shown in space 51, and the direction of gas vent 216 from gas offtake port 212 is shown.

Figure 10A:
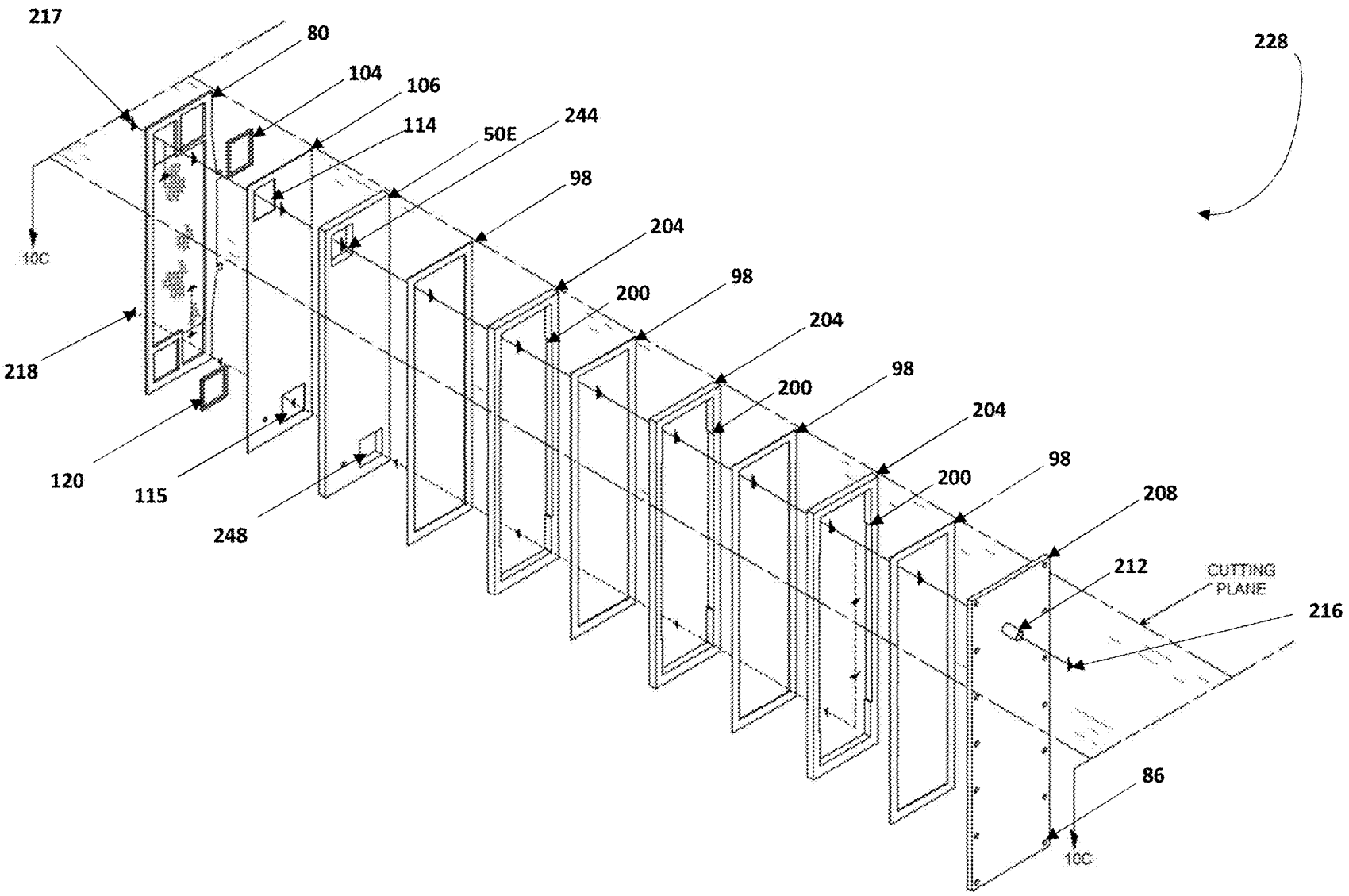
FIG. 10A shows an exploded front perspective of one end of a unipolar filter press electrolyser for alkaline water electrolysis according to another embodiment of the invention depicting a filter press frame component, a substantially flat and thick inner end plate, several modular rigid hollow frame components to create longitudinal space in the filter press, a substantially flat end clamping component, and several gasket and masking components for sealing purposes, with arrows to represent the off-take of gas products out of the filter press.
Figure 10B:
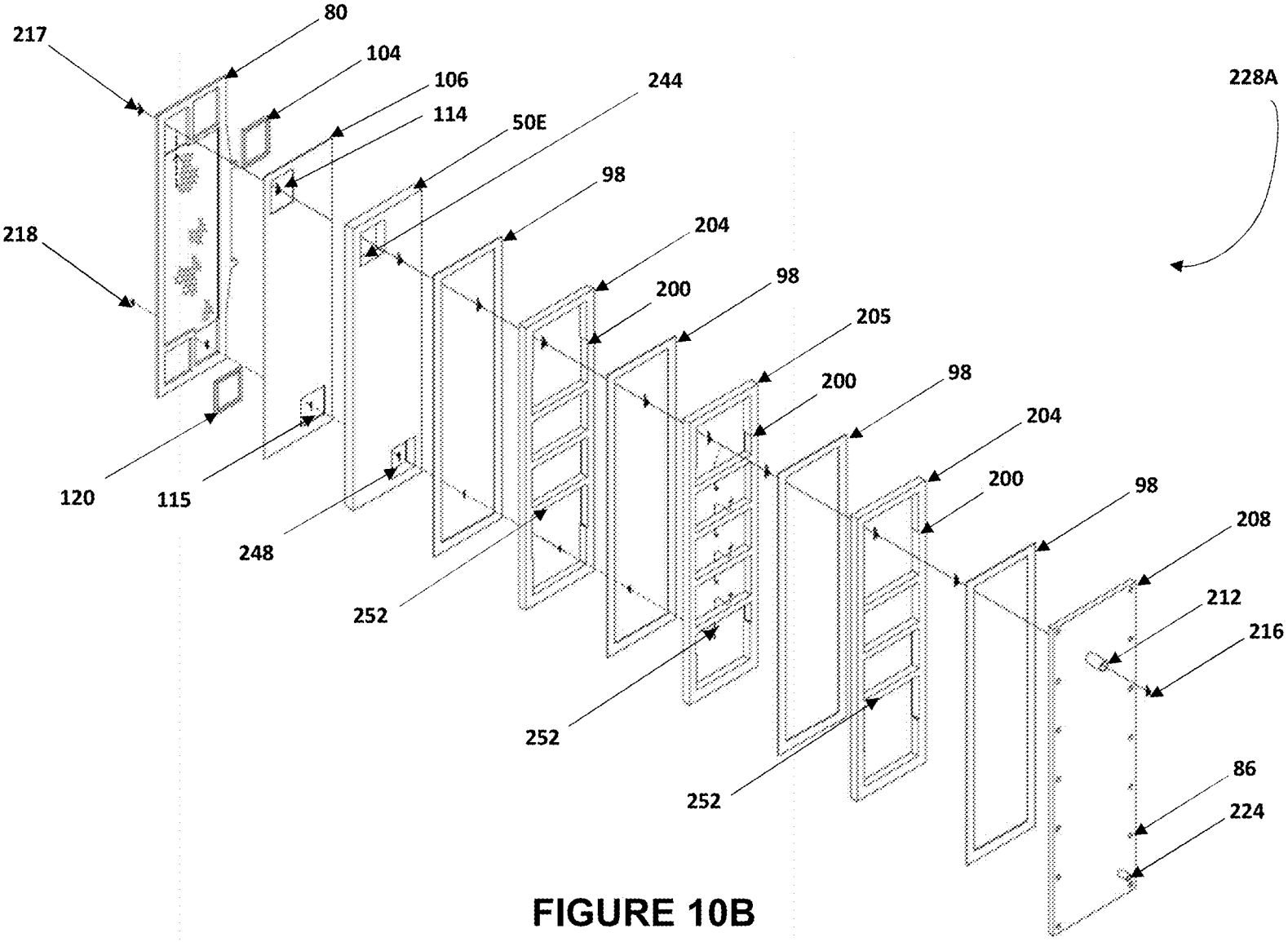
FIG. 10B shows an exploded front perspective view similar to that shown in FIG. 10A except that lateral cross struts are provided within the hollow frame components for structural rigidity.

An example of lateral rungs (also referred to herein as lateral cross struts) may be seen in FIG. 10B, where lateral cross struts 252 are provided within hollow frame components 204 between opposing edges of each rigid hollow frame components 204 to reinforce structural rigidity of hollow frame components 204. In the embodiment of end assembly 228A depicted in FIG. 10B, hollow frame components 204 and 205 are shown, where hollow frame component 205 is placed in between adjacent hollow frame components 204. While hollow frame components 204 each have three lateral cross struts 252, hollow frame component 205 has four lateral cross struts. In addition, the lateral cross struts 252 of hollow frame component 205 cross opposing edges of hollow frame component 205 at different points within the hollow of hollow frame component 205 in comparison with the lateral cross struts 252 of hollow frame component 204. When hollow frame components 204 and 205 are pressed together, the staggering of the lateral cross struts 252 between the hollow frame components 204 and 205 produces a path for liquid electrolyte to flow. The hollow frame components 204 and 205 with lateral cross struts 252 allow for higher pressurized alkaline water unipolar filter press electrolyser assemblies 16. While in the current embodiment, hollow frame components 204 and 205 have at least three lateral cross struts 252, it is contemplated that hollow frame components 204 and 205 are not limited to at least three lateral cross struts 252 and may be any number of lateral cross struts 252.

Referring to FIG. 7F, end clamp 82B may also include fins 184 protruding on the outer surface or exterior surface for cooling. In the current embodiment, fins 184 extend longitudinally along the outer surface of end clamp 82B. The addition of fins 184 to end clamp 82B may improve natural convection and radiation from the unipolar filter press electrolyser assembly 16. Fins 184 create channels for natural circulation to assist in cooling of the fluids within the unipolar filter press electrolyser assembly 16. Fins 184 may also be added to other embodiments of end clamp 82B, such as end clamp 144C (as shown in FIG. 7G) and end clamp 208A (as shown in FIG. 7H).

Referring to FIG. 5B, end clamp 82A may also include reinforcing gussets 138 to further improve the rigidity of end clamp 82A. Reinforcing gussets 138 allow a higher pressure within hollow space 154, and also allows a higher pressure difference/drop between hollow space 154 and the pressure outside end assembly 160.

In alternate embodiments, end clamp 82A may further include feed and removal channels, ports for outlet and inlet fluids (reactant feed in/water feed in), sensing devices, such as level switches or other instrumentation and windows that enable the observation of sensing devices and fluids within the unipolar filter press electrolyser assembly 16.

With respect to the structural integrity of the above mentioned embodiments, FIG. 5B shows a cross-sectional view of the disassembled end assembly 160. The direction of external forces 162 and 158 and internal force 166 are shown. External forces 162 and 158 and internal force 166 are applied when the components are assembled and clamped as end assembly 160.

FIG. 7B shows a cross-sectional view of the disassembled end assembly 168 with end clamp 144B. The direction of external forces 162 and 158 and internal force 166 are shown. External force 162 and internal forces 158 and 166 are applied when the components are assembled and clamped as end assembly 160.

Figure 6A:
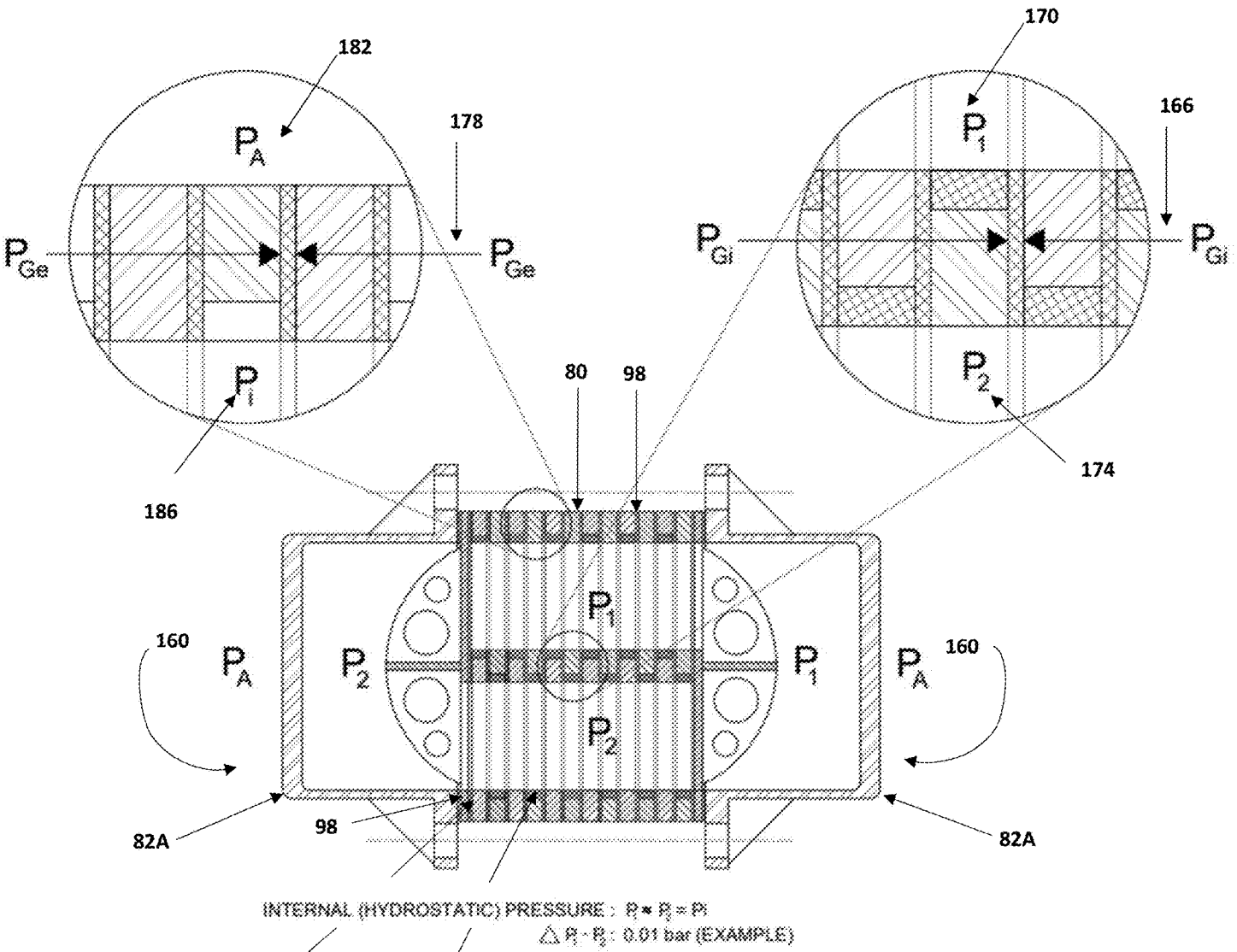
FIG. 6A shows another cross-sectional view similar to that shown in FIG. 5C except that this view depicts an assembled unipolar filter press system for alkaline water electrolysis in accordance with an embodiment of the invention provided with two of the end assemblies shown in FIG. 5C, the view further presenting magnifications of regions of differential pressure within the filter press to demonstrate the pressure differentials.

By separating focus of end clamp 82A on applying external forces 162 and 158 rather than internal force 166, end clamp 82A can be optimized to not require further mechanical rigidity where it would be required to apply internal force 166. FIG. 6A shows a top-down cross-sectional view of an assembled unipolar filter press electrolyser assembly 16.170 $P_1$ and 174 $P_2$ are internal pressures. $P_A$ is the external or atmospheric pressure. $P_{Gi}$; is the pressure applied by internal force 166, and $P_{Ge}$ is the pressure applied by external forces 162 and 158. In typical electrolyser filter presses, $P_{Gi}$ is applied against the force of $P_A$, which can be a large differential, and would require a substantial member to allow it to apply $P_{Gi}$. In the current embodiment, magnifications of regions of differential pressure within unipolar filter press electrolyser assembly 16 are presented to demonstrate the pressure differential between the exterior and interior of the unipolar filter press electrolyser assembly 16 (182 $P_A$, 186 $P_i$) and the pressure on gaskets adjacent-most to unipolar filter press electrolyser assembly 16 exterior (178 $P_{Ge}$) is greater than the pressure differential within the unipolar filter press electrolyser assembly 16 between adjacent transfer passageways (170 $P_1$, 174 $P_2$) of hydrogen and oxygen gas products and the pressure on gaskets adjacent-most to the unipolar filter press electrolyser assembly 16 interior (166 $P_{Gi}$). Furthermore, end plate component 50A may be favourably manufactured with greater rigidity required to apply internal force 166 due to the inner end plate only being exposed to $P_1$ 170 and $P_2$ 174 which will be nominally the same as opposed to being exposed to either or $P_1$ 170 or $P_2$ 174 versus $P_A$ 182.

End clamp 82A may be fabricated from corrosion resistant materials, such as steel, nickel, low carbon steel, stainless steel, titanium, Hastelloy® (nickel-molybdenum alloy) or a polymer material, such as polypropylene. Furthermore, end clamp 82A may be coated in nickel plating to for corrosion resistance. There are multiple non-limiting methods to manufacture end clamp 82A, including, but not limited to, stamped, roll-formed, machined, cast, laser cut, and plasma cut. End clamp 82A may also be covered by a masking material which may be any one or combination of, but not limited to: fluoropolymers, elastomers, thermoplastics (specifically Santoprene™), ethylene propylene diene monomer (EDPM) rubber, Teflon™, polypropylene, polyethylene or Viton™ rubber.

It will occur to the person skilled in the art that different configurations of embodiments of end clamp 82A and embodiments of end plate component 50A are available. For example, FIG. 10A shows embodiment end assembly 228, where embodiment of end plate component 50E is assembled with several modular rigid hollow frame components 204, and end clamp 208. As mentioned previously, end plate component 50E is substantially flat and rigid and does not have mechanical support components 58, 62, 74 and 78, and end clamp 208 includes gas offtake port 212, where gas is vented out in direction 216. End assembly 228 further includes several non-limiting gaskets 98 and 106, along with masking components 104 and 120 for sealing purposes. Similar to other masking components, masking components 104 and 120 provide electrical and chemical isolation to end assembly 160, effectively electrically and physically insulating end plate component 50A from stacked array of CCFs 9.

Figure 10C:
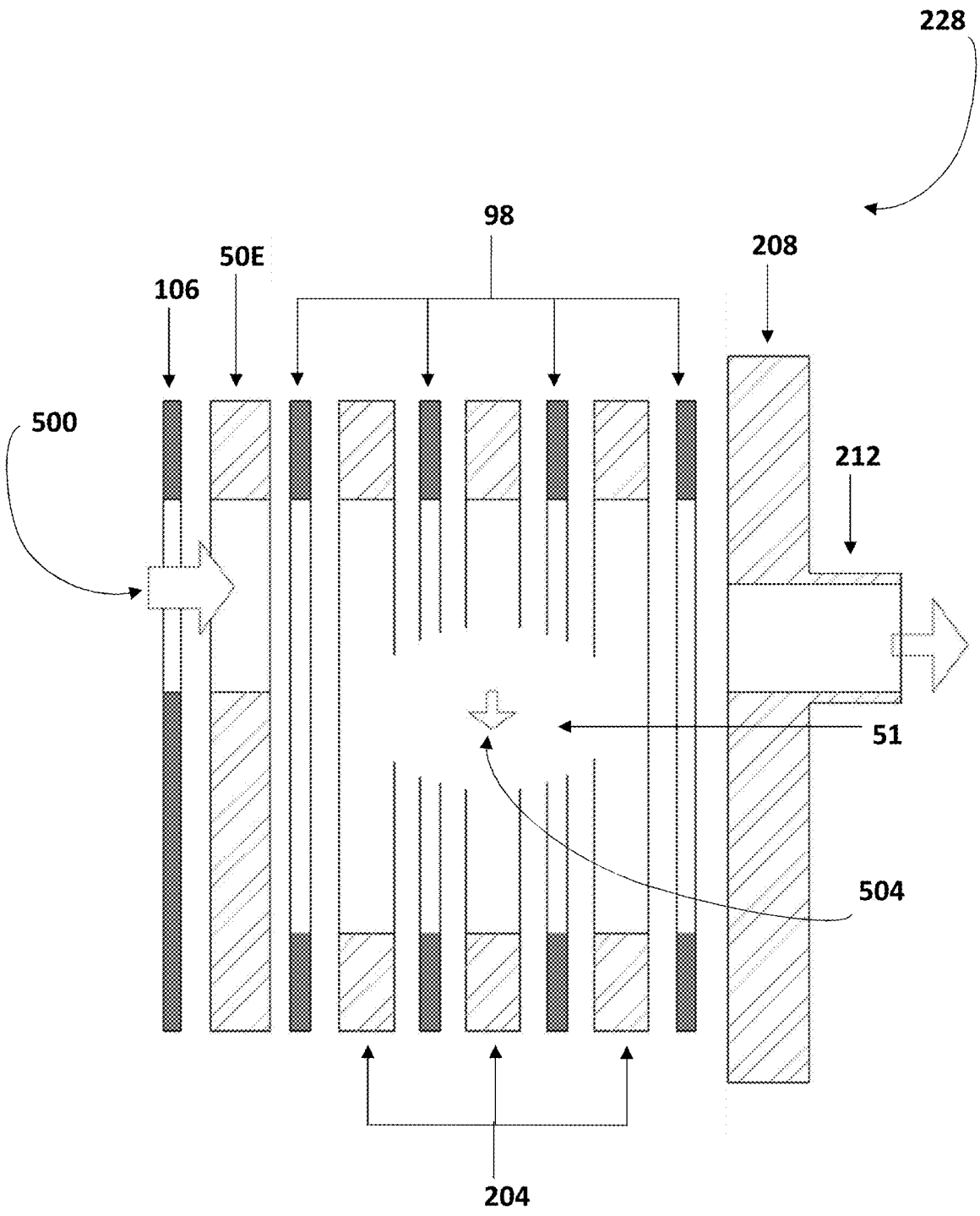
FIG. 10C shows a cross-sectional view of the end assembly depicted in FIG. 10A taken along line "10C-10C", but with various components shown assembled (except for the filter press frame component which has been omitted) and arrows included to indicate the flow of gases and fluids.

FIG. 10C shows a top-down cross-sectional view of the disassembled end assembly 228. The direction of gas/electrolyte mixture 500 is shown going through aperture 54 of end plate component 50A. The electrolyte return 504 is shown in space 51, and the direction of gas vent 216 from gas offtake port 212 is shown.

Figure 3E:
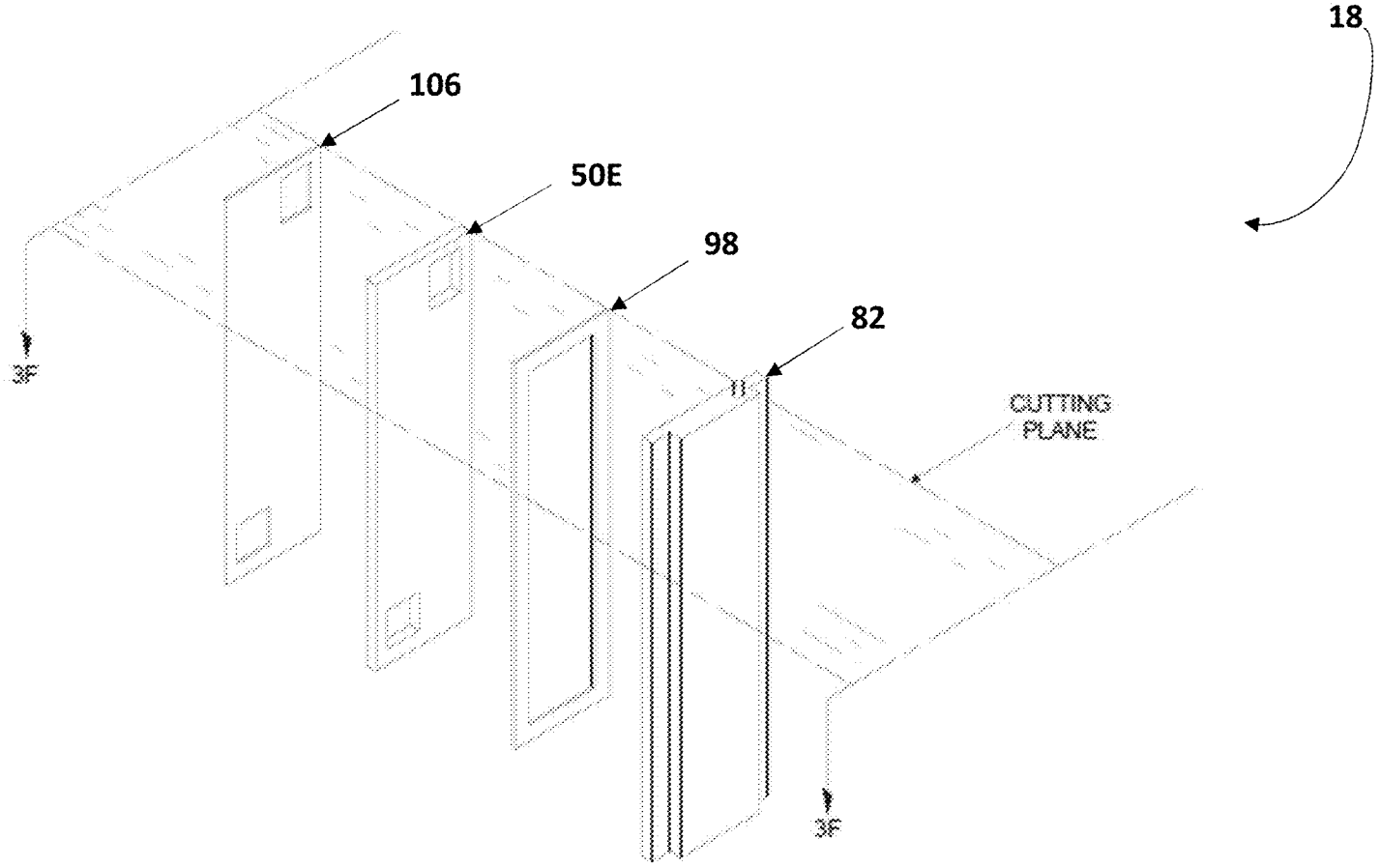
FIG. 3E shows a perspective view of a simplified end assembly of a unipolar filter press electrolyser, comprising an end plate component and an end clamp and several gasket and masking components for sealing purposes, with arrows showing the direction of product gas off-take and liquid electrolyte recirculation.
Figure 3F:
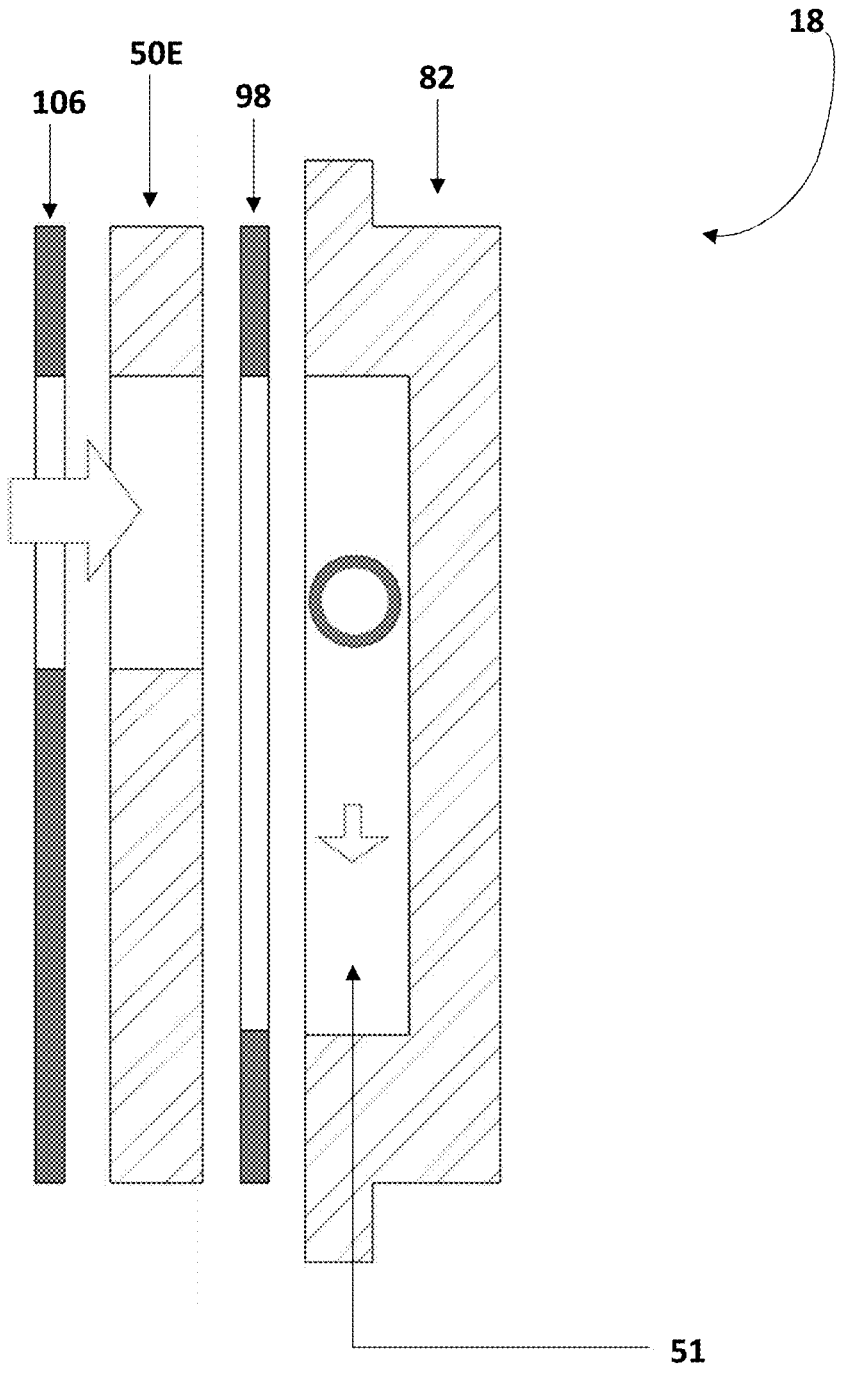
FIG. 3F shows an exploded cross-sectional view of the end assembly shown in FIG. 3E taken along line "3F-3F".

In an alternate embodiment, FIG. 3E and FIG. 3F show an embodiment of a simplified end assembly 18. End assembly 18 includes end plate component 50E and end clamp 82 having defined therein a passageway chamber for electrolyte recirculation. In this embodiment, end plate component 50E is thicker than those of previous embodiments and is estimated to be at least 1 inch thick. The thickness of end plate component 50E is dependent on the sealing pressure force required and other design attributes, including, but not limited to, the lateral width of the filter press stack. The direction of gas/electrolyte mixture 500 is shown going through aperture 54 of end plate component 50E. The electrolyte return 504 is shown in space 51, and the direction of the gas vent 122 from gas offtake port 90 is shown. In this embodiment, gas offtake port 90 is placed on a different surface of 82, however, it is also possible to be placed vertically at position 508.

In another embodiment of end assembly 16, end plate component 50A may be omitted. Such a system without an end plate component 50A could include one or more rigid frames 204 with channels enabling gas/liquid separation and electrolyte circulation. Included in this end assembly 160 is said frames 204 with lateral struts 252 to transfer clamping force from the end clamp 208 element to the internal fluid isolation channels in the absence of end plate component 50A. These members would have material removed to form channels to allow movement of gases and liquids within the stacked array of CCFs 9 including the electrolyte return chamber. Also in this end assembly 160 is a substantially rigid, flat end clamp 208 that is sufficiently designed to apply mechanical force across the internal portion of the frames 204 to transfer clamping forces from the end clamp 208 to the internal fluid isolation channels. Said end clamp 208 may allow for accessory ports as previously described in the present disclosure and continues to provide external clamping and sealing of the end assembly 160. The rigid frames transfer mechanical force applied by the end clamp 208 and provide channels for electrolyte circulation, removing the requirement for a separate end plate component 50A. Said channels in said frames are created on both the upper and lower sections of the frame 204 in both a vertical and horizontal arrangement, where added offset rungs or lateral cross struts between adjacent said frames may be used for further aid in downward fluid circulation and operation at elevated pressure.

This end assembly, however, is less favourable than the previously described embodiments due to the significant modifications to the end clamp 208 to allow it to apply the necessary mechanical force to seal the internal channels within the unipolar filter press electrolyser assembly 16. Additionally, there is the added expenditure in manufacturing said channels in said frames 204. This description is exemplary and should not be interpreted as limiting the invention or its applications.

As previously mentioned, end plate component 50A may also be nickel plated to avoid corrosion. An advantage to the current embodiment of end assembly 160, where end plate component 50A and end clamp 82A are two separate pieces, is that nickel plating may be easier and more cost effective than other end assembly designs which are one piece. Other end assembly designs may be exceedingly difficult to nickel coat due to components within the end assembly being in substantially enclosed chambers where electro or chemical plating is a challenging to apply. With end plate component 50A and end clamp 82A in two separate pieces, when both pieces are nickel plated, sharp corners and crevices where fluid may become stagnate and form localized galvanic cells, are minimized and protected from corrosion.

The figures of the present disclosure illustrate end assembly 160 as being clamped using tie rods and are consequently provided with tie rod holes 86. Tie rod holes 86 are on the flange surrounding the body of end clamp 82A, and can receive tie rods for clamping the end clamp to the filter press stack.

Those skilled in the art will understand that any such tie rod holes shown are non-limiting and are rendered optional or in some cases unnecessary in the event unipolar filter press electrolyser assembly 16 is clamped using an external filter press clamping device. For example, in the event the end assemblies of the present disclosure are applied to a double plate unipolar filter press electrolyser assembly 16, no tie rod holes need be provided in the end assemblies, as a common set of tie rods would extend in the lateral space in between the two assemblies.

In the aforementioned embodiments, use of low-cost materials for production of each end assembly 160 is enabled due to electrolytic isolation between each unipolar filter press electrolyser assembly 16. Therefore, as previously mentioned end clamp 82A and end plate component 50A may be made from thin, nickel-plate low carbon steel, or for certain parts that are cathodic or at a floating potential for which iron does not corrode, low carbon steel itself. The cost of a unipolar filter press electrolyser assembly 16 will generally be reduced by adding additional electrode plates within the unipolar filter press electrolyser assembly 16 itself while operating the unipolar filter press electrolyser assembly 16 at a proportionally higher current based on the increase of electroactive surface area. This is due to the cost of the end assemblies 160 being amortized over a greater amount of hydrogen production. This increase in surface area and amperes improves space efficiency, enables the use of high current rectifiers, and reduces the unit capital system costs as the total plant hydrogen production requirement grows from less than 5 MW to greater than 100 MW.

Other beneficial features include the ability of end assembly 160 to be used for large scale alkaline water electrolysis and scale hollow space 51 more efficiently by adjusting the cross-sectional area for different fluxes of electrolyte recirculation and reactant addition and product removal. Electrical connections between each adjacent unipolar filter press electrolyser assembly 16 (as shown in FIG. 2) are also non-limiting (i.e., connections between adjacent unipolar filter press electrolyser assembly 16 can be created using a conductive bus bar clamping system or through a double electrode plate as shown in U.S. patent application Ser. No. 16/994,125 Integrally Combined Current Carrier Circulation Chamber and Frame for use in Unipolar Electrochemical Devices, Andrew T. B. Stuart, 2020. Electrolytes are kept isolated between adjacent unipolar filter press electrolyser assemblies 16 to prevent bypass current or current reversal.

Although the foregoing description and accompanying drawings related to specific preferred embodiments of the present invention as presently contemplated by the inventor, it will be understood that various changes, modifications and adaptions, may be made without departing from the spirit of the invention.

The embodiments for which an exclusive privilege or property is claimed are as follows:

1. An end assembly for use in a unipolar filter press electrolyser having a plurality of filter press frame components arranged to form a filter press stack, the end assembly comprising:

an end plate component having:

at least two apertures defined therein, the at least two apertures being alignable with channels formed in the filter press frame components of the plurality when the end assembly is operatively connected to the filter press stack, the at least two apertures include a first aperture configured to receive a stream of liquid electrolyte and gases from the filter press stack, and a second aperture configured to receive a stream of recirculated liquid electrolyte; the first aperture being disposed adjacent to an upper end of the end plate component and a second aperture being disposed adjacent to a lower end of the end plate component;

a pair of opposite faces and at least one mechanical support member attached to one of the faces of the end plate component; the at least one mechanical support member being positioned near one of the upper and lower ends of the end plate component to reinforce an area about one of the first and second apertures; the at least one mechanical support includes a first mechanical support positioned near the upper end of the end plate component to reinforce an area about the first aperture; the first mechanical support includes a horizontal flange portion;

a first gasket member positionable between the end plate component and one of the filter press frame components of the plurality;

an end clamp configured to apply a clamping force on the end plate component to securely retain the filter press stack, the end clamp having an open-faced shell formed with a hollow, and at least one gas offtake port configured to discharge out of the unipolar filter press electrolyser gases separated from the stream of liquid electrolyte and gases; the hollow of the shell of the end clamp being configured to redirect a stream of liquid electrolyte substantially free of gases toward the second aperture for recirculation in the filter press stack; and a second gasket member positionable between the end plate component and the end clamp, the second gasket configured to provide a seal for isolating the internal pressure within the filter press stack from external atmospheric pressure.

2. The end assembly of claim 1, wherein:

the first aperture has a shape selected from the group consisting of a square and a rectangle; and the area about the first aperture being reinforced by the first mechanical support includes an area along at least one edge of the first aperture.

3. The end assembly of claim 2, wherein the at least one edge of the first aperture includes a horizontal edge and vertical edge.

4. The end assembly of claim 1, wherein:

the first aperture is defined by upper and lower spaced apart horizontal edges and right and left spaced apart vertical edges; and the area about the first aperture being reinforced by the first mechanical support includes an area along the lower horizontal edge and one of the right and left vertical edges.

5. The end assembly of claim 1, wherein:

the first aperture is defined by upper and lower spaced apart horizontal edges and right and left spaced apart vertical edges; and the area about the first aperture being reinforced by the first mechanical support includes an area along the upper horizontal edge and one of the right and left vertical edges.

6. The end assembly of claim 1, wherein:

the first aperture is defined by upper and lower spaced apart horizontal edges and right and left spaced apart vertical edges; and a part of the horizontal flange portion runs adjacent to the lower horizontal edge.

7. The end assembly of claim 1, wherein the horizontal flange portion has a semi-circular profile.

8. The end assembly of claim 7, wherein the vertical flange portion has a quarter-circular profile.

9. The end assembly of claim 1, wherein the first mechanical support includes a vertical flange portion arranged relative to the horizontal flange portion to form a generally T-shaped structure.

10. The end assembly of claim 9, wherein:

the first aperture is defined by upper and lower spaced apart horizontal edges and right and left spaced apart vertical edges; and a part of the horizontal flange portion runs adjacent to the lower horizontal edge; and the vertical flange portion runs adjacent one of the right and left vertical edges.

11. The end assembly of claim 9, wherein at least one of the horizontal flange portion and the vertical flange portion have through-holes defined therein for the flow of gasses and liquids.

12. The end assembly of claim 1, wherein the first mechanical support includes a vertical flange portion fixed to the horizontal flange portion to form a generally T-shaped structure.

13. The end assembly of claim 1, wherein the at least one mechanical support includes a second mechanical support positioned near the lower end of the end plate component to reinforce an area around the second aperture.

14. The end assembly of claim 13, wherein:

the second aperture has a shape selected from the group consisting of a square and a rectangle; and the area about the second aperture being reinforced by the second mechanical support includes an area along at least one edge of the second aperture.

15. The end assembly of claim 14, wherein the at least one edge of the second aperture includes a horizontal edge and vertical edge.

16. The end assembly of claim 13, wherein:

the second aperture is defined by upper and lower spaced apart horizontal edges and right and left spaced apart vertical edges; and the area about the second aperture being reinforced by the second mechanical support includes an area along the upper horizontal edge and one of the right and left vertical edges.

17. The end assembly of claim 13, wherein:

the second aperture is defined by upper and lower spaced apart horizontal edges and right and left spaced apart vertical edges; and the area about the second aperture being reinforced by the second mechanical support includes an area along the lower horizontal edge and one of the right and left vertical edges.

18. The end assembly of claim 13, wherein the second mechanical support includes a horizontal truss portion.

19. The end assembly of claim 18, wherein the second mechanical support includes a vertical truss portion arranged relative to the horizontal truss portion to form a generally T-shaped structure.

20. The end assembly of claim 18, wherein the second mechanical support includes a vertical truss portion fixed to the horizontal truss portion to form a generally T-shaped structure.

21. The end assembly of claim 1, wherein the first and second apertures are disposed diagonally relative to each other.

22. An end assembly for use in a unipolar filter press electrolyser having a plurality of filter press frame components arranged to form a filter press stack, the end assembly comprising:

an end plate component having:

at least two apertures defined therein, the at least two apertures being alignable with channels formed in the filter press frame components of the plurality when the end assembly is operatively connected to the filter press stack, the at least two apertures include a first aperture configured to receive a stream of liquid electrolyte and gases from the filter press stack, and a second aperture configured to receive a stream of recirculated liquid electrolyte; the first aperture being disposed adjacent to an upper end of the end plate component and a second aperture being disposed adjacent to a lower end of the end plate component;

a pair of opposite faces and at least one mechanical support member attached to one of the faces of the end plate component; the at least one mechanical support member being positioned near one of the upper and lower ends of the end plate component to reinforce an area about one of the first and second apertures; the at least one mechanical support includes a first mechanical support positioned near the upper end of the end plate component to reinforce an area about the first aperture; the first mechanical support includes a horizontal truss portion;

a first gasket member positionable between the end plate component and one of the filter press frame components of the plurality;

an end clamp configured to apply a clamping force on the end plate component to securely retain the filter press stack, the end clamp having an open-faced shell formed with a hollow, and at least one gas offtake port configured to discharge out of the unipolar filter press electrolyser gases separated from the stream of liquid electrolyte and gases; the hollow of the shell of the end clamp being configured to redirect a stream of liquid electrolyte substantially free of gases toward the second aperture for recirculation in the filter press stack; and a second gasket member positionable between the end plate component and the end clamp, the second gasket configured to provide a seal for isolating the internal pressure within the filter press stack from external atmospheric pressure.

23. The end assembly of claim 22, wherein the first mechanical support includes a vertical truss portion arranged relative to the horizontal truss portion to form a generally T-shaped structure.

24. The end assembly of claim 22, wherein the first mechanical support includes a vertical truss portion fixed to the horizontal truss portion to form a generally T-shaped structure.

25. The end assembly of claim 22, wherein:

the second aperture is defined by upper and lower spaced apart horizontal edges and right and left spaced apart vertical edges; and a part of the horizontal flange portion runs adjacent to the upper horizontal edge.

26. The end assembly of claim 25, wherein the horizontal flange portion has a semi-circular profile.

27. The end assembly of claim 22 wherein the second mechanical support includes a vertical flange portion arranged relative to the horizontal flange portion to form a generally T-shaped structure.

28. The end assembly of claim 27, wherein:

the second aperture is defined by upper and lower spaced apart horizontal edges and right and left spaced apart vertical edges; and a part of the horizontal flange portion runs adjacent to the upper horizontal edge; and the vertical flange portion runs adjacent one of the right and left vertical edges.

29. The end assembly of claim 27, wherein the vertical flange portion has a quarter-circular profile.

30. The end assembly of claim 27, wherein at least one of the horizontal flange portion and the vertical flange portion have through-holes defined therein for the flow of gasses and liquids.

31. The end assembly of claim 22 wherein the second mechanical support includes a vertical flange portion fixed to the horizontal flange portion to form a generally T-shaped structure.

* * * * *